US005335897A

United States Patent [19]

Coble

[11] Patent Number: 5,335,897

[45] Date of Patent: Aug. 9, 1994

[54] INSULATED FURNACE DOOR SYSTEM

[76] Inventor: Gary L. Coble, R.D. #2, Box 214, DuBois, Pa. 15801

[21] Appl. No.: 785,775

[22] Filed: Oct. 31, 1991

Related U.S. Application Data

[60] Continuation-in-part of Ser. No. 693,346, Apr. 30, 1991, which is a continuation-in-part of Ser. No. 609,643, Nov. 6, 1990, Pat. No. 5,048,802, which is a continuation-in-part of Ser. No. 373,672, Jun. 28, 1989, abandoned, which is a continuation of Ser. No. 213,699, Jun. 30, 1988, abandoned, which is a continuation-in-part of Ser. No. 907,473, Sep. 15, 1986, Pat. No. 4,755,236, which is a division of Ser. No. 732,400, May 9, 1985, Pat. No. 4,611,791, which is a continuation-in-part of Ser. No. 456,823, Jan. 10, 1983, Pat. No. 4,516,758.

[51] Int. Cl.[5] ..... F27D 1/18

[52] U.S. Cl. ..... 266/286; 432/250; 266/44

[58] Field of Search ..... 266/280, 283, 286, 263; 432/250

[56] References Cited

U.S. PATENT DOCUMENTS

| | | | |
|---|---|---|---|
| 1,733,647 | 10/1929 | Coghlan | 110/173 |
| 2,024,649 | 12/1935 | Longenecker | 110/173 |
| 2,148,054 | 2/1939 | Berlek | 266/43 |
| 2,148,281 | 2/1939 | Scott, Jr. | 72/16 |

(List continued on next page.)

FOREIGN PATENT DOCUMENTS

| | | |
|---|---|---|
| 522018 | 2/1956 | Canada . |
| 251908 | 10/1912 | Fed. Rep. of Germany . |
| 1106446 | 5/1961 | Fed. Rep. of Germany . |
| 1131246 | 6/1962 | Fed. Rep. of Germany . |
| 2928964 | 1/1981 | Fed. Rep. of Germany . |
| WO81/03221 | 11/1981 | PCT Int'l Appl. . |
| 0393333 | 11/1973 | U.S.S.R. . |
| 1490129 | 10/1977 | United Kingdom . |
| 1571789 | 7/1980 | United Kingdom . |
| 2095382 | 9/1982 | United Kingdom . |
| 2096752 | 10/1982 | United Kingdom . |

OTHER PUBLICATIONS

Babcock & Wilcox, *Saber Bloc-A High Performance Weld-on Module*, Apr. 1982, 4 page brochure, Augusta, Ga. 30903.

(List continued on next page.)

*Primary Examiner*—Scott Kastler
*Attorney, Agent, or Firm*—David A. Burge

[57] ABSTRACT

An insulated door or wall panel assembly utilizes a compressively sandwiched array of bodies of insulation that extend side-by-side to define a substantially contiguous interior surface that can withstand direct exposure to high heat energy, for example by being positioned to extend about peripheral portions of a treatment chamber of a high temperature furnace to cooperate with adjacent furnace structure to minimize loss of heat energy from the treatment chamber. A rigid frame, typically formed from steel, overlies exterior portions of the sandwiched bodies of insulation and is securely connected thereto for positioning and supporting the array, whereby a rugged panel assembly is provided that is well suited for use as a closure to selectively permit access through a furnace wall opening to the treatment chamber. Included in the sandwiched array are a plurality of rigid cast refractory members that extend in spaced, substantially parallel relationship, with inner portions thereof defining a major part of the surface area of the interior surface of the panel assembly. Bodies of fiber-type refractory, typically in log-like form, are compressively sandwiched between adjacent ones of the cast refractory members. Such portions of the interior surface as are defined by inner portions of the cast refractory members store impingent heat energy received from the treatment chamber and serve to "reradiate" stored heat energy back into the treatment chamber. Selected portions of the interior surface that are not defined by the cast refractory are defined by compressed stacks of bodies of fiber-type refractory that are securely connected to the frame.

48 Claims, 7 Drawing Sheets

U.S. PATENT DOCUMENTS

| | | | |
|---|---|---|---|
| 2,231,498 | 2/1941 | Geistler | 266/43 |
| 2,233,650 | 4/1941 | Swartz | 110/180 |
| 2,849,219 | 8/1958 | Boron | 263/40 |
| 2,998,236 | 8/1961 | Cramer et al. | 263/40 |
| 3,039,754 | 6/1962 | Jones | 263/47 |
| 3,081,074 | 3/1963 | Blackman et al. | 263/47 |
| 3,112,737 | 12/1963 | Reighart | 122/499 |
| 3,149,827 | 9/1964 | Whitten | 263/47 |
| 3,226,899 | 1/1966 | Blickle | 52/506 |
| 3,429,370 | 2/1969 | Blackman | 165/47 |
| 3,606,288 | 9/1971 | Bloom | 266/5 |
| 3,693,955 | 9/1972 | Wald et al. | 266/5 |
| 3,819,468 | 6/1974 | Sauder et al. | 161/152 |
| 3,892,396 | 7/1975 | Monaghan | 266/43 |
| 3,930,916 | 1/1976 | Shelley | 156/71 |
| 3,953,009 | 4/1976 | Kan | 266/283 |
| 3,993,237 | 11/1976 | Sauder et al. | 229/140 |
| 4,055,926 | 11/1977 | Byrd, Jr. | 52/475 |
| 4,079,184 | 3/1978 | Bahout et al. | 266/280 |
| 4,120,641 | 10/1978 | Myles | 432/3 |
| 4,194,282 | 3/1980 | Byrd, Jr. | 29/451 |
| 4,218,212 | 8/1980 | Eschenberg et al. | 432/247 |
| 4,222,337 | 9/1980 | Christiansen | 110/336 |
| 4,287,839 | 9/1981 | Severin et al. | 110/331 |
| 4,287,940 | 9/1981 | Corbett, Jr. | 165/48 |
| 4,300,882 | 11/1981 | Werych | 432/247 |
| 4,310,302 | 1/1982 | Thekdi et al. | 432/205 |
| 4,316,603 | 2/1982 | Steffen | 266/282 |
| 4,324,602 | 4/1982 | Davis et al. | 156/71 |
| 4,335,870 | 6/1982 | Diener et al. | 266/193 |
| 4,336,086 | 6/1982 | Rast | 156/71 |
| 4,366,255 | 12/1982 | Lankard | 501/95 |
| 4,367,255 | 1/1983 | Blohm | 428/99 |
| 4,516,758 | 5/1985 | Coble | 266/263 |
| 4,611,791 | 9/1986 | Coble | 266/263 |
| 4,647,022 | 3/1987 | Coble | 266/282 |
| 4,653,171 | 3/1987 | Coble | 29/455 |
| 4,755,236 | 7/1988 | Coble | 148/43 |
| 5,048,802 | 9/1991 | Coble | 266/263 |

OTHER PUBLICATIONS

Johns-Manville, *Application Information Z-Blok Insulation Guide*, Jan. 1980, 20 page brochure, Denver, Colo. 80217.

Johns-Manville, *Z-Blok & Cerablanket Application Information*, Sep. 1979 4 page brochrue, Denver, Colo. 80217.

Johns-Manville, *Z-Bloc Refactory Liner Modules For Furnace & Kiln Linings*, Sep. 1979, 4 page brochure, Denver, Colo. 80217.

Johns-Manville, *Cera Form Special Shapes*, Jan. 1979, 4 page brochure, Denver, Colo. 80217.

Johns-Manville, *Cera Form Boards*, Aug. 1979, 4 page brochure, Denver, Colo. 80217.

Johns-Manville, *Z-Blok Refractory Fiber Modules*, Feb. 1981, 6 page brochure, Denver, Colo. 80217.

*Iron & Steel Engineer* Magazine, Article entitled "Batch Anneal Modeling Study" by Albert R. Perrin et al, vol. 60, #6, pp. 39-45, Jun. 1983.

Lee Wilson Engineering Co., Inc., 8 page brochure entitled "Lee Wilson-Fore-Most Engineers & Mfgrs. of Annealing Furnaces . . . ", Jun. 1968, Cleveland, Ohio 44116.

Lee Wilson Engineering Co., Inc., 4 page brochure entitled "Annealing Furnace Parts", copyright Dec. 1980, Cleveland, Ohio 44116.

Wahl Refractories, Inc., 4 page Product Specification for "X-Cel Cast 60" bearing an issue date of Mar. 17, 1988, Fremont, Ohio 43420.

INSULATED FURNACE DOOR SYSTEM

CROSS-REFERENCE TO RELATED AND RELEVANT PATENTS AND APPLICATIONS

The present application is a continuation-in-part of application Ser. No. 07/693,346 filed Apr. 30, 1991, referred to hereinafter as the "Parent Case," which case was, in turn, filed as a continuation-in-part of application Ser. No. 07/609,643 filed Nov. 6, 1990 (issued Sep. 17, 1991 as U.S. Pat. No. 5,048,802) which case, in turn, was filed as a continuation-in-part of application Ser. No. 07/373,672 filed Jun 28, 1989 (abandoned), which case, in turn, was filed as a continuation of application Ser. No. 07/213,699 filed Jun. 30, 1988 (abandoned), which, in turn, was filed as a continuation-in-part of application Ser. No. 06/907,473 filed Sep. 15, 1986 (issued Jul. 5, 1988 as U.S. Pat. No. 4,755,236), which case, in turn, was filed as a division of application Ser. No. 06/732,400 filed May 9, 1985 (issued Sep. 16, 1986 as U.S. Pat. No. 4,611,791), which case, in turn, was filed as a continuation-in-part of application Ser. No. 06/456,823 filed Jan. 10, 1983 (issued May 14, 1985 as U.S. Pat. No. 4,516,758). With the exception of the "Parent Case," all of the patents and applications that are identified above will be referred to collectively hereinafter as the "Grandparent Cases." The disclosures of all of the Parent and Grandparent Cases are incorporated herein by reference.

Reference also is made to two additional applications (and to patents that have issued therefrom) that are descendants of the earliest-filed of the above-listed Grandparent Cases. These include application Ser. No. 06/659,856 filed Oct. 11, 1984 (issued Mar. 31, 1987 as U.S. Pat. No. 4,653,171), which, in turn, was filed as a division of application Ser. No. 06/477,219 filed Mar. 21, 1983 (issued Mar. 3, 1987 as U.S. Pat. No. 4,647,022), the latter of which was filed as a continuation-in-part of said earliest-filed of the Grandparent Cases, namely application Ser. No. 06/456,823 filed Jan. 10, 1983 (issued May 14, 1985 as U.S. Pat. No. 4,516,758). U.S. Pat. Nos. 4,653,171 and 4,647,022 (and the applications from which they issued) relate to features of furnace door construction and reconstruction, and will be referred to hereinafter as the "Door Patents," the disclosures of all of which are incorporated herein by reference.

BACKGROUND OF THE INVENTION

1. Field of the Invention

The present invention relates generally to energy efficient wall and closure systems for minimizing loss of thermal energy from thermal treatment chambers of high temperature furnaces and the like, such as are used in industry to reheat slabs, billets and blooms of steel or the like. Features of the invention are well suited for use in constructing movable panels that typically are used as doors to selectively close furnace openings to periodically permit entrance into and/or exit from treatment chambers of sizable bodies of steel that need to be uniformly reheated to enable the steel to be properly worked, for example by forging.

More particularly, features of the present invention relate to such diverse subject matter as: methods of forming elongate cast refractory members that are adapted for direct, rigid connection to an external frame for cooperating with other refractory insulation to provide frame-supported insulated panels; methods of constructing frame-supported insulated panels that incorporate arrays of elongate, cast refractory members that extend in side-by-side relationship with bodies of fiber-type refractory compressed between adjacent pairs of the cast refractory members; and to frame-supported insulated panels that include compressively sandwiched arrays of cast refractory members that advantageously cooperate to define interior surface portions which have a capability to store impingent heat energy from a high temperature treatment chamber and to re-radiate stored heat energy back into the treatment chamber.

2. Prior Art

Large industrial apparatus for effecting thermal treatment of sizable charges of material that are admitted sequentially to and discharged sequentially from a thermal treatment chamber often are provided with inlet and outlet openings located on opposite sides of the treatment chamber. It is well known to provide such apparatus with insulated closures of various types for selectively opening and closing the inlet and outlet openings.

For example, in the steel industry it is well known to utilize what is referred to as a "reheat furnace" to sequentially heat large, pre-formed bodies of steel to desired temperatures to enable the heated bodies to be "worked" or otherwise formed, typically by rolling or by forging. A reheat furnace characteristically has a treatment chamber that is capable of receiving a plurality of large steel bodies such as slabs, billets or blooms of steel. The bodies of steel to be heated typically are fed through the treatment chamber relatively slowly in a direction of travel that extends from an inlet or entry opening located on one side of the treatment chamber to an outlet or exit opening located on an opposite side of the treatment chamber.

The referenced Parent Case and the referenced Door Patents describe and illustrate selected features of steel reheat furnaces, and disclose inventions that address needs that are present in industry for insulated panel assemblies that are adequately rugged and heat resistant to permit their being used as furnace closures, typically as entry and exit doors for steel reheat furnaces. All three of these referenced cases disclose the use of fiber-type refractory insulation to line and/or define interior surface portions of furnace doors. Moreover, the two referenced Door Patents disclose furnace door embodiments that employ compressed stacks of fiber-type refractory bodies that are securely anchored to and supported by exterior frames.

While compressed stacks of fiber-type refractory bodies supported by exterior frames are well suited to serve the needs of furnace treatment chambers that operate at or below about 2,400 degrees Fahrenheit, present-day materials from which compressible fiber-type refractory bodies are formed tend not to provide insulated panel assemblies that are characterized by long service life if directly exposed for substantial periods of time to treatment chamber temperatures that exceed about 2,400 degrees Fahrenheit. Thus, while fiber-type refractory materials may become available at some time in the future that can be substituted for present-day materials and that will perform durably and offer good service life even when exposed for substantial periods of time to temperatures exceeding about 2,400 degrees Fahrenheit, at present, the environments within which features of the referenced Door Patents are most suitably deployed are those wherein temperatures do not exceed about 2,400 degrees Fahrenheit.

Another concern that arises when relatively large interior surface areas of fiber-type refractory panels are exposed for significant periods of time to high temperature environments is the tendency of fibers from the refractory to become airborne. As a general rule, the greater the exposed surface area of fiber-type refractory, the greater is the concern that minuscule pieces of fiber may become airborne. Furthermore, the higher the temperature to which the refractory is exposed, the more rapidly the fiber-type refractory tends to deteriorate so as to present conditions that are increasingly susceptible to tiny pieces of fiber breaking away and becoming airborne.

Still another concern (that inherently is present to some degree in almost all applications wherein refractory fiber-type insulation is used to form wall portions of a high temperature treatment chamber) is referred to by the term "shadow effect." Whereas wall portions that are formed from refractory brick readily store and re-radiate impingent heat energy, wall portions formed from refractory fiber-type insulation do not. Thus, while re-radiation of heat energy from refractory brick-lined walls will assist in maintaining nearby portions of steel bodies at desired high temperatures, refractory fiber-lined walls tend not to re-radiate heat energy and therefore tend to permit nearby portions of uniformly heated bodies of steel to cool undesirably, just as if a "shadow" had been cast over such portions to shield them from a source of heat energy (hence the origin of the term "shadow effect").

The "shadow effect" of such refractory fiber-type insulation as lines the interior surface of an exit closure of a steel reheat furnace tends to pose a particular concern when bodies of steel need to be discharged from a steel reheat furnace in a uniformly heated state, for example for use in forging processes. Success in carrying out forging processes depends in significant measure on supplying steel that is uniformly heated to within a relatively narrow range of desired working temperatures. If the "shadow effect" of fiber-type refractory causes a slab of re-heated steel to lose its uniform working temperature, the heated slab may have to be shunted aside until it can be put through still another re-heat cycle.

Despite prior proposals, a need remains for frame-supported insulated panels that alleviate "shadow effect" concerns, that minimize airborne fiber concerns, and that function well in high temperature environments wherein temperatures are maintained within the range of about 2400 to about 2800 degrees Fahrenheit.

SUMMARY OF THE INVENTION

The present invention addresses the foregoing and other needs and drawbacks and of the prior art by providing novel and improved frame-supported insulated panels and related methods of fabrication and construction of such panels and their component parts.

In preferred practice, a refractory-lined insulated panel is formed utilizing an array of elongate, rigid castings of refractory material that are assembled with bodies of fiber-type refractory compressed therebetween so that the panel has a substantially contiguous interior surface that is capable of storing and re-radiating heat energy to minimize concerns of "shadow effect," that minimizes airborne fiber concerns, and that can serve as a closure for at least a portion of an opening into the treatment chamber of a high temperature furnace.

By utilizing cast refractory members to define a major portion of the interior surface that is directly exposed to the treatment chamber environment of a high temperature furnace, an insulated panel member that embodies the preferred practice of the present invention is endowed with a capability to perform without undue deterioration in the presence of temperatures that exceed 2,400 degrees Fahrenheit. Indeed, by selecting suitable present-day refractory materials, such panel assemblies typically can be made to perform without undue deterioration in the presence of temperatures that may rise as high as about 2,800 degrees Fahrenheit. Moreover, as improvements are made in refractory materials during years to come, insulated panels that embody features of the present invention undoubtedly will be capable of performing without undue deterioration in the presence of even higher temperatures.

By utilizing cast refractory members that have enlarged formations near their inner ends (i.e., typically members that have substantially T-shaped cross sections and that are deployed with the "cross-bar" portion of each "T" extending substantially within a common plane so that the "cross-bars" define a major portion of the interior surface of their associated panel), it is possible to compressively clamp and securely retain one or even a plurality of log-like bodies of fiber-type refractory between each adjacent pair of the cast refractory members. In preferred practice, the log-like bodies of fiber-type refractory are interposed between the "stem" portions of each adjacent pair of the T-shaped cast refractory members. By this arrangement, a majority of the material of the sandwiched log-like bodies of fiber-type refractory is located "outwardly" with respect to the panel's interior surface, and a major portion of the interior surface is defined by the "cross-bars" of the T-shaped cast refractory members.

In preferred practice, such bodies of fiber-type refractory as are sandwiched within the side-by-side array of T-shaped cast refractory members essentially are confined to U-shaped "pockets" that are defined between stem portions of adjacent pairs of the T-shaped members. Also, pieces of hard board insulation preferably are inserted between outer ends of the T-shaped members. Optionally, such spaces as may be present between adjacent pairs of "cross-bars" may be filled with refractory mortar. By this arrangement, little, if any, of the fiber-type refractory is exposed so as to permit the escape of minuscule fiber particles that might become airborne.

Concerns of "shadow effect" are minimized by arranging the cast refractory members to extend in arrays that cause such major surface areas of the insulated panels as will be positioned near heated bodies of steel or the like (that are present within a treatment chamber that is bordered by the insulated panels) to have a capability to store impingent heat energy and to re-radiate such energy so that the panels do not act as "heat sinks" that cause the heated bodies of steel to become non-uniformly heated.

Thus, a number of the "article of manufacture" features of the preferred practice of the present invention are embodied in an insulated door or wall panel assembly that utilizes a compressively sandwiched array of bodies of insulation that extend side-by-side to define a substantially contiguous interior surface that can withstand direct exposure to high heat energy (e.g., by being positioned to extend about peripheral portions of a treatment chamber of a high temperature furnace to cooperate with adjacent furnace structure to minimize loss of heat energy from the treatment chamber). A rigid frame, typically formed from steel, overlies exterior portions of the sandwiched bodies of insulation and is securely connected thereto for positioning and supporting the array, whereby a rugged panel assembly is provided that is well suited for use as a closure to selectively permit access through a furnace wall opening to the treatment chamber. Included in the sandwiched array are a plurality of rigid cast refractory members that extend in spaced, substantially parallel relationship, with inner portions thereof defining a major part of the surface area of the interior surface of the panel assembly. Bodies of fiber-type refractory, typically in log-like form, are compressively sandwiched between adjacent ones of the cast refractory members. Such portions of the interior surface as are defined by inner portions of the cast refractory members store impingent heat energy received from the treatment chamber and serve to "re-radiate" stored heat energy back into the treatment chamber. Selected portions of the interior surface that are not defined by the cast refractory are defined by compressed stacks of bodies of fiber-type refractory that are securely connected to the frame.

Other "article of manufacture" and "method" features of the preferred practice of the present invention reside in the details of construction of the cast refractory members and the manner in which the cast refractory members are secured to and supported by an exterior frame. Preferably, T-shaped castings of refractory are molded in juxtaposition with narrow lengths of sheet steel that have transversely extending reinforcing members welded thereto. The reinforcing members project into the castings during the molding of the cast refractory and ultimately serve to very securely connect each of the refractory castings to its own separate steel sheet. To securely mount the castings on a supporting frame, the sheets of steel that are rigidly connected to the castings are rigidly connected to the frame, preferably as by welding.

Still other "method" features of the preferred practice of the present invention reside in methods by which compressed sandwich-type arrays of side-by-side cast refractory members are assembled so as to compressively clamp bodies of fiber-type refractory between adjacent pairs of the cast refractory members, with the sandwiched stacks of compressed refractory being utilized to form insulated panel assemblies of the type described.

BRIEF DESCRIPTION OF THE DRAWINGS

These and other features, and a fuller understanding of the present invention may be had by referring to the following description and claims, taken in conjunction with the accompanying drawings, wherein:

DESCRIPTION OF THE PREFERRED EMBODIMENT

Figure 1:
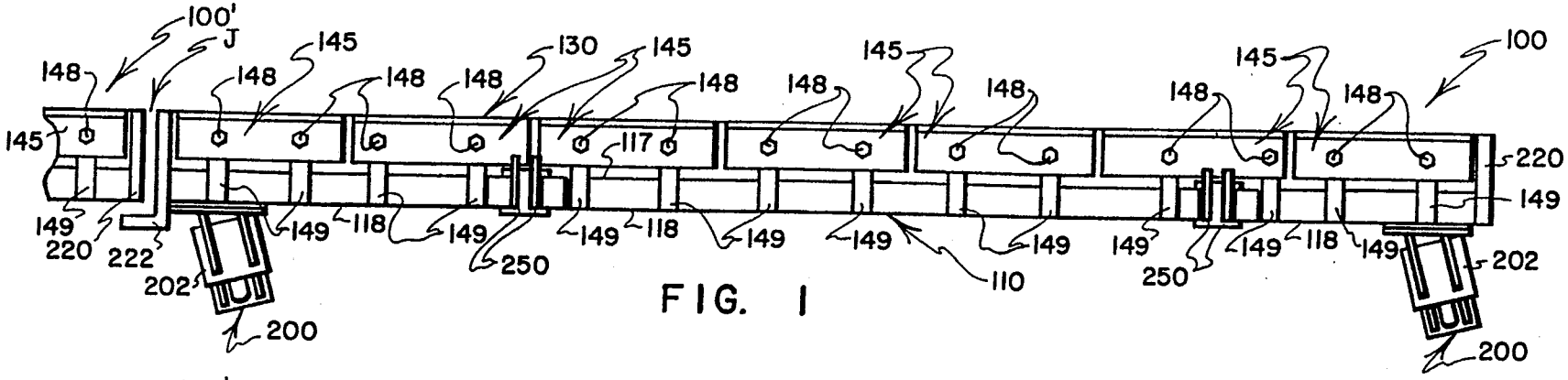
FIG. 1 is a top plan view of a first embodiment of insulated panel that includes features of the preferred practice of the present invention, with the view also showing an end portion of an adjacent, similarly configured insulated panel.

In accordance with the preferred practice of the present invention, and representing the best mode known to the inventor hereof for practicing the present invention, features of three typical insulated panel assembly embodiments are illustrated in the drawings and described below. There are a great many similarities between and among the features of these embodiments, as will become apparent from the discussion that follows.

Figure 9:
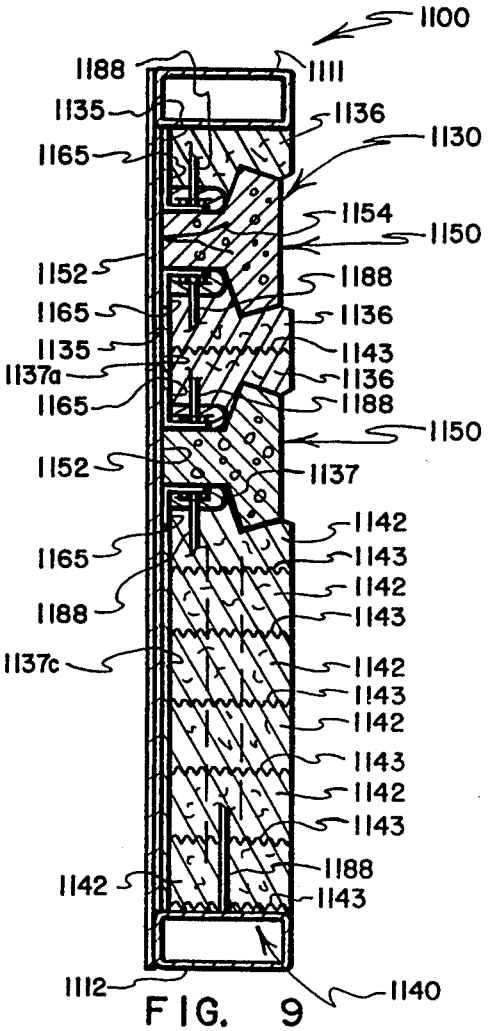
FIG. 9 is a sectional view similar to FIG. 5 but showing a second embodiment of insulated panel construction that incorporates features of preferred practice.
Figure 11:
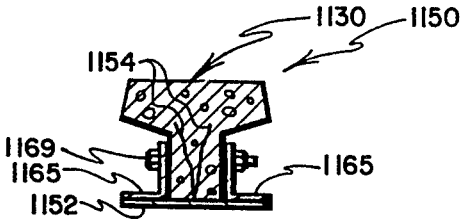
FIG. 11 is a sectional view as seen from a plane indicated by a line 11—11 in FIG. 10; and, FIG. 12 is a sectional view similar to FIGS. 5 and 9 but showing a third embodiment of insulated panel construction that incorporates features of preferred practice.
Figure 10:
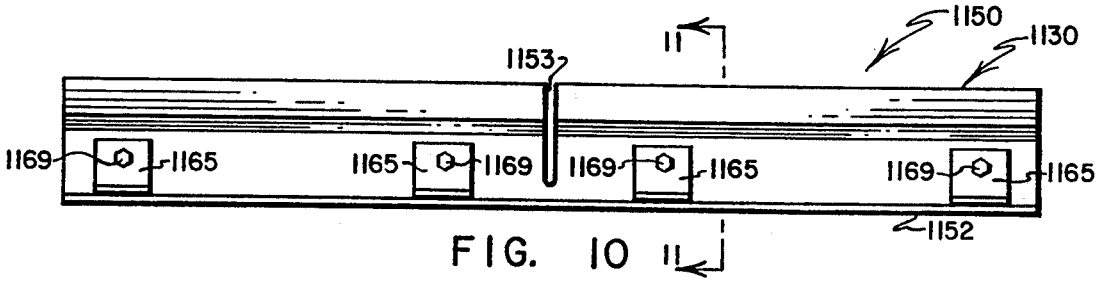
FIG. 10 is top plan view of one of the cast refractory members that is utilized in the second embodiment.
Figure 12:
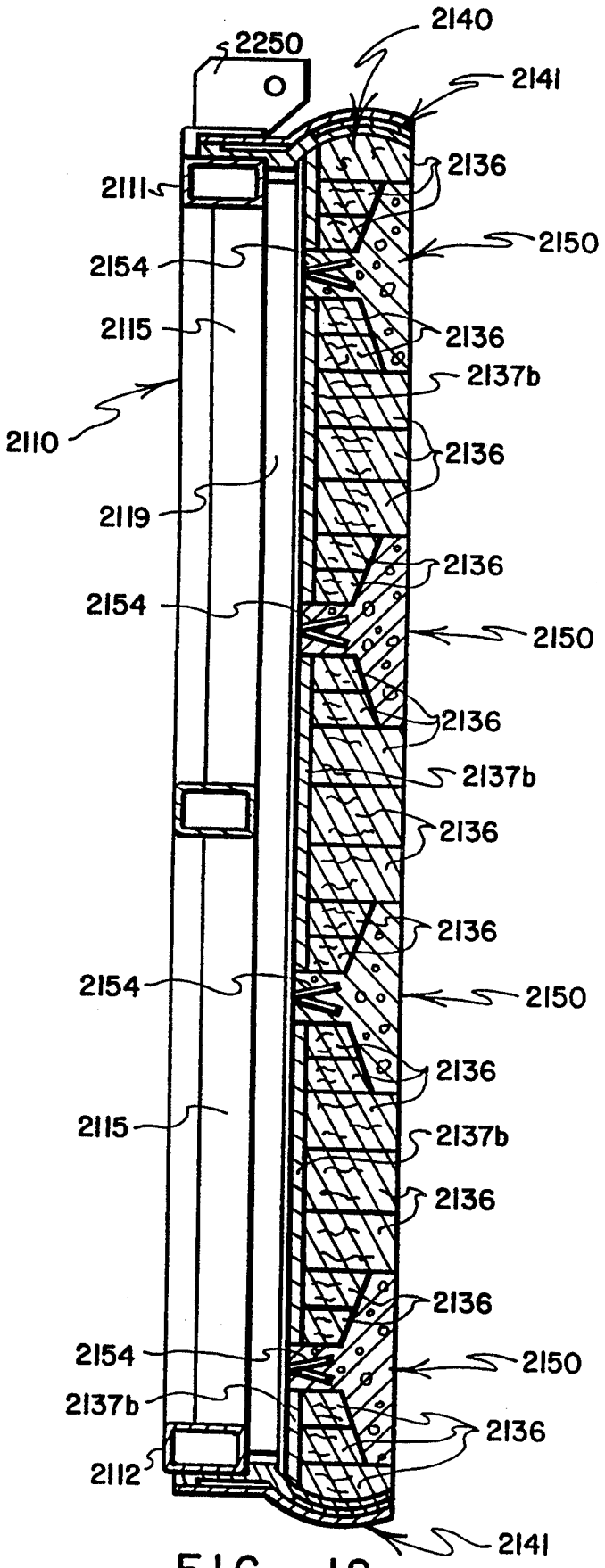

Features of the first embodiment will be discussed in conjunction with FIGS. 1–8, with the first embodiment of insulated furnace door panel being indicated generally by the numeral 100 in FIGS. 1–5. Features of the second embodiment are depicted in FIGS. 9–11, with the second embodiment of insulated furnace door panel being indicated generally by the numeral 1100. Features of the third embodiment are depicted in FIG. 12, with the third embodiment of insulated furnace door panel being indicated generally by the numeral 2100. Because the first, second and third embodiments 100, 1100 and 2100 have components and features that are substantially equivalent in general nature and function (i.e., they "correspond" even though the precise forms that they take may differ), corresponding components and features of the first and second embodiments 100, 1100 are indicated in FIGS. 1–8 and FIGS. 9–11, respectively, by numerals that are identical except that they differ by a magnitude of one thousand. Likewise, corresponding components and features of the first and third embodiments 100, 2100 are indicated in FIGS. 1–8 and 12, respectively, by numerals that are identical except that they differ by a magnitude of two thousand.

Referring to FIGS. 1–5, a first embodiment of insulated furnace door panel is indicated generally by the numeral 100. Toward the left side of FIGS. 1 and 2, right end portions of an adjacent, substantially identical insulated door panel 100' are shown, with the remainder of the door panel 100' being broken away. As those who are skilled in the art readily will understand, a set of adjacent insulated door panels (with the set including the panels 100, 100' and perhaps one or more similarly configured additional panels, not shown) can be utilized to selectively open and close an exit opening of a steel reheat furnace. While neither a steel reheat furnace nor structure defining an exit opening of such a furnace are depicted in the drawings, the referenced Door Patents (the disclosures of which are incorporated herein by reference) discuss selected features of conventional steel reheat furnaces and depict structure that defines furnace exit openings through which heated bodies of steel (typically steel slabs) are discharged or extracted. Likewise, the referenced Parent Case (the disclosure of which is incorporated herein by reference) discusses and depicts structure that extends about an inlet opening through which bodies of steel to be heated (typically steel slabs) are introduced into the treatment chamber or hearth of a steel reheat furnace.

Figure 5:
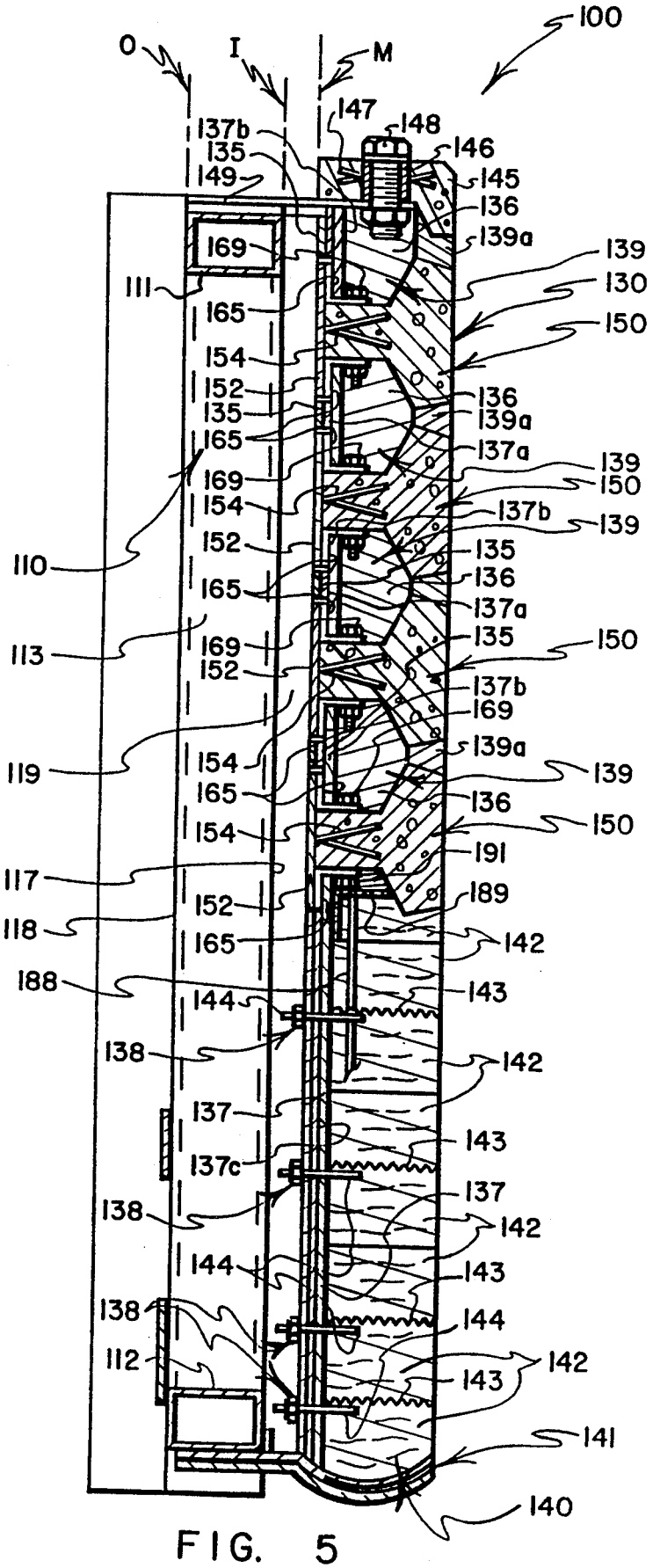
FIG. 5 is a sectional view, on an enlarged scale, as seen from a plane indicated by a line 5—5 in FIG. 2.

Referring to FIGS. 1–4 and particularly to FIG. 5, the insulated door panel 100 has an inwardly-facing surface 130 that also is referred to herein as the "interior surface 130" of the panel 100. The interior surface 130 is cooperatively defined by inwardly facing surface portions of a plurality of bodies of refractory material that comprise a "compressed stack" of refractory, indicated generally by the numeral 140. The stack 140 has a thickness (typically six or seven inches) that makes up about half of the total thickness of the insulated door panel 100.

Overlying exterior surface portions of the stack 140 is a welded steel framework 110 that also is referred to herein as the "frame 110." As will be explained in greater detail later herein, the stack 140 is securely connected to the frame 110 for movement therewith—which is another way of saying that at least selected ones of the bodies of refractory material that comprise the stack 140 are rigidly connected to the frame 110 to hold the bodies of refractory material securely in place in juxtaposition to the frame 110 so as to be movable in unison with the frame 110 to selectively open and close a treatment chamber opening of a high temperature furnace (not shown).

Figure 2:
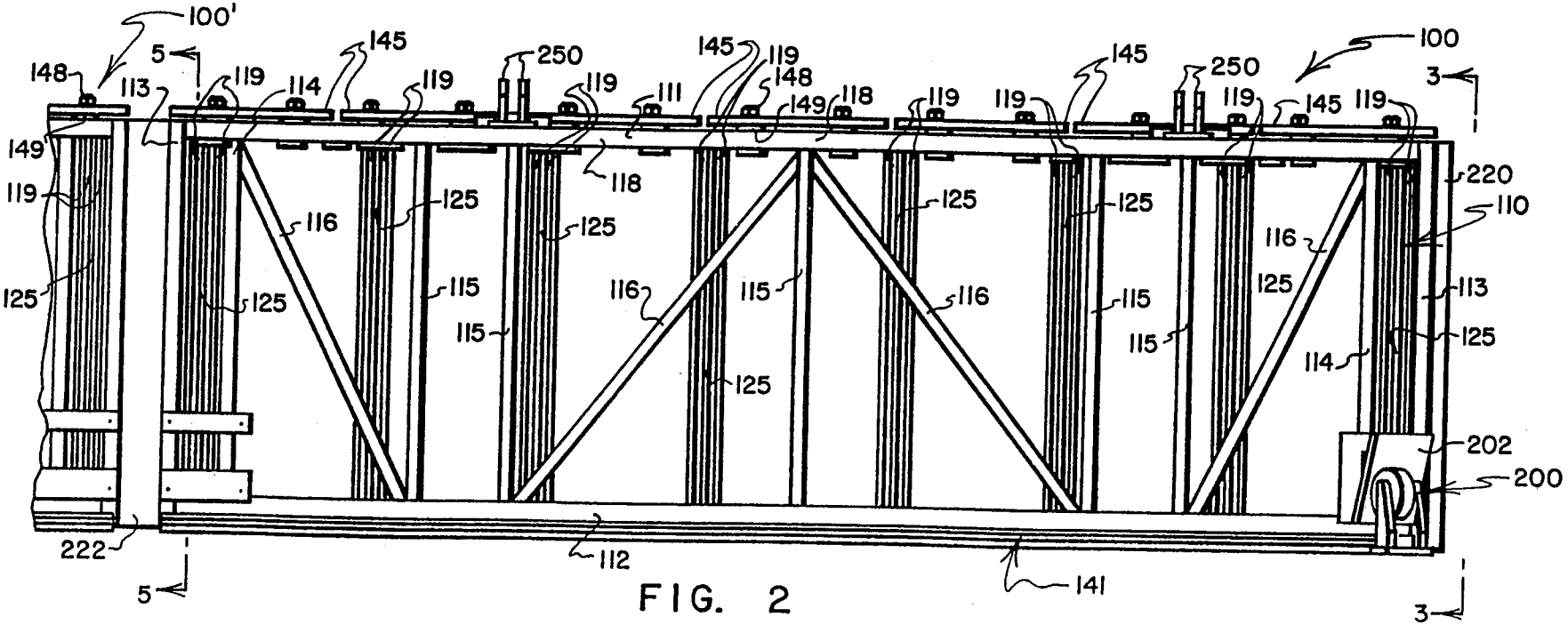
FIG. 2 is an exterior side elevational view thereof but with one of two wheeled guide assemblies removed therefrom to permit details of underlying construction to be viewed.
Figure 4:
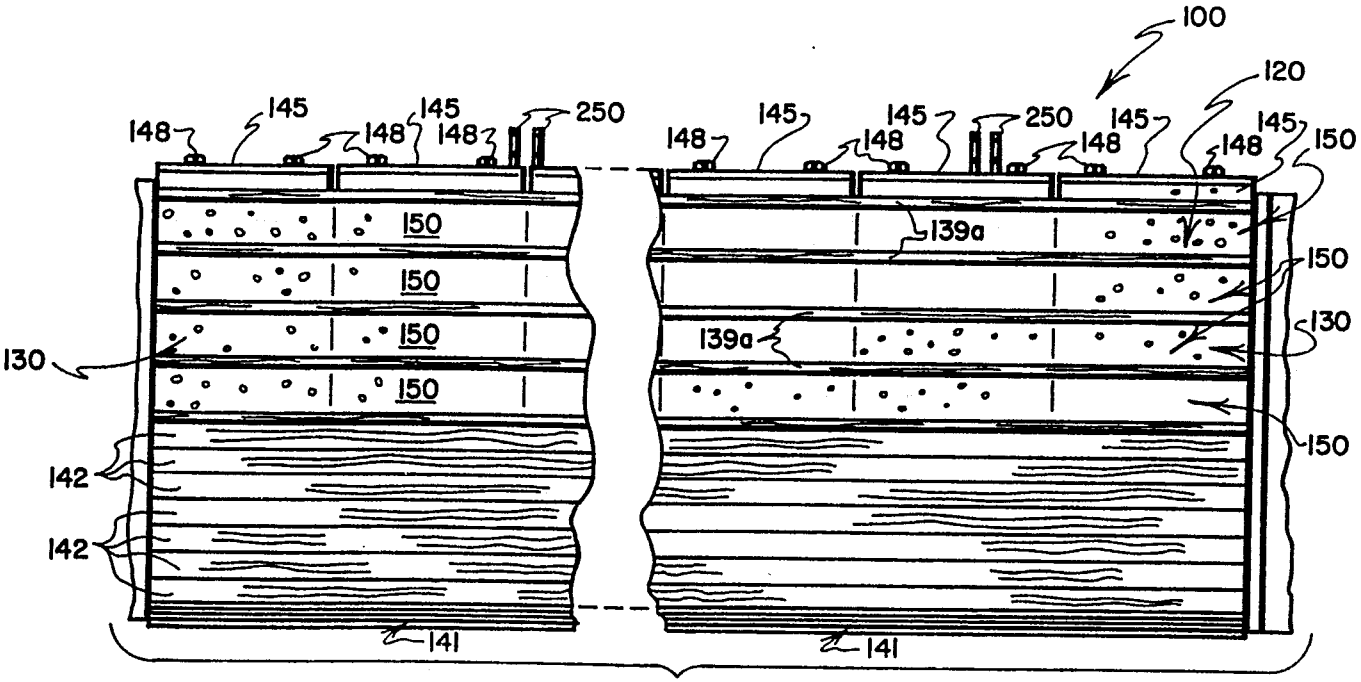
FIG. 4 is a foreshortened interior side elevational view of the first embodiment.
Figure 3:
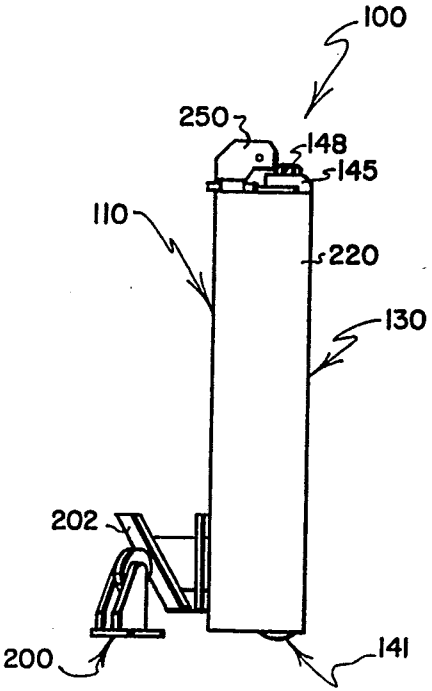
FIG. 3 is an end elevational view as seen from a plane indicated by a line 3—3 in FIG. 2.

Turning now to a more detailed description of features of the various components of the insulated furnace door panel 100, and referring initially to FIGS. 2 and 5, the frame 110 is of generally rectangular form. In the form illustrated in the drawings, the frame 110 is configured to have a width (i.e., height) of about 5 to 6 feet, and a length of about 17 to 19 feet; however, features of the invention are not limited in their applicability to use with panels having these or other specific dimensions—and, as those who are skilled in the art readily will understand, structural members can be added to or withdrawn from the frame 110 as may be needed to provide supporting frames of a wide range of sizes and shapes so that correspondingly configured insulated panels can be built. Inasmuch as the preferred practice of the present invention is not tied to the use of a frame that has elements in common with the frame 110, it is possible to substitute an entirely different frame (not shown) can be substituted for the frame 110 so as to permit a different size and shape of insulated panel to be formed, for example a "cover" for what is referred to in the art as a "soaking pit," or for a ladle, etc.

In preferred practice, structural steel members, typically including cut lengths of channel, angle iron and rectangular tube stock are welded together to form the frame 110. For example, top, bottom and end members 111, 112 and 113, respectively, are formed typically from 5 by 3 inch rectangular tubular members that have nominal wall thicknesses of about 5/16 inch and are welded together to form a substantially rectangular perimeter of the frame 110.

Referring to FIG. 2, a pair of uprights 114 are formed from the same stock as is used to form the members 111, 112 and 113. The uprights 114 are cut to length and welded in place to rigidly interconnect the top and bottom members 111, 112 at locations that are relatively near to but are spaced from the end members 113. Still other uprights 115 typically are formed from 3 by 2 inch rectangular tube stock that has a nominal wall thickness of 3/16 inch are cut to length, and are welded in place so as to rigidly interconnect the top and bottom members 111, 112 at spaced locations between the uprights 114. Bracing members 116 typically are formed from 3 by 2 inch rectangular tube stock that has a nominal wall thickness of 3/16 inch, are miter-cut and welded in place so as to extend between the bottom member 112 and upper end regions of selected ones of the uprights 114, 115.

The members 114, 115 and 116 extend parallel to but are located between parallel inner and outer planes that are indicated in FIG. 5 by the letters "I" and "O, respectively. The planes "I" and "O" are defined by inwardly-facing and outwardly-facing surfaces 117, 118 of the frame members 111, 112 and 113. The welded assembly thus described forms a rigid, rectangular, "flat" framework that typically has a thickness of about 5 inches.

Referring to FIGS. 2 and 5, welded to the inwardly-facing surfaces 117 of at least the frame members 111, 112 and 113 (and preferably also to inwardly-facing surfaces of the bracing members 116) are paired arrays of vertically extending angle irons 119. The angle irons 119 typically are formed from stock measuring about 2 by 2 inches that has a nominal thickness of $\frac{1}{4}$ inch. The angle irons 119 are arranged in pairs that have inwardly-facing surfaces 120 that extend in a common "mounting plane" which is indicated in FIG. 5 by the letter "M."

Referring to FIG. 5, the mounting plane M parallels the inner and outer planes I and 0. Referring to FIG. 2, the angle irons 119 of each pair have spaces 125 therebetween. Typically, the spaces 125 are about $\frac{1}{2}$ inch wide and are of uniform width as they extend vertically between adjacent pairs of the co-planar surfaces 120. By this arrangement, the paired angle irons 119 serve both to define flat, inwardly-facing mounting surfaces 120 (best seen in FIG. 5) to which selected refractory mountings can be welded, and to provide a plurality of spaced, vertically extending slots 125 (best seen in FIG. 2) through which threaded fasteners can be inserted to assist in coupling other refractory members to the frame 110 (as will be explained in greater detail later herein).

Before turning to a discussion of the manner in which various types of refractory members (including "cast refractory" members 150) are arranged in the stack 140 and are secured to the frame 110, a summary of what is intended by the term "cast refractory" will be presented, and reference will be made both to FIG. 7 wherein a preferred embodiment of cast refractory member 150 is depicted, and to FIG. 8 wherein a mold 170 for use in forming the refractory member 150 is somewhat schematically depicted.

What is meant herein by use of such terms as "cast refractory," "cast-type refractory member," "refractory casting" and the like is an elongate member molded from a castable refractory material such as is sold by Wahl Refractories, Inc. of Fremont, Ohio 43420 under the trade name or trademark X-CEL CAST 60—a high density, low porosity, low cement, castable refractory substance that, after being cast, exhibits good volume stability, is quite strong when kept within a service temperature range of about 70 degrees Fahrenheit to about 3000 degrees Fahrenheit, and has good resistance to abrasion and chemical attack. The preferred castable refractory has a relatively high Alumina content (typically an $Al_2O_3$ content of about 59 percent), and typically has other oxygen compounds present therein such as $SiO_2$, CaO, $Fe_2O_3$, $TiO_3$ and MgO, with $SiO_2$ typically forming about 38 percent of the content of the refractory while other oxygen compounds together with alkalies typically form a total of about 3 percent.

The refractory preferably takes the form of a powder until mixed with a small quantity of water whereupon a viscous slurry-like mixture is formed that can be poured into a mold and vibrated to form a void-free casting. During the mixing of the refractory powder, it is preferable to add a quantity of stainless steel "needles" to the powder (i.e., typically thin, wire-like pieces of stainless steel about 1½ to 2 inches long) to serve as a form of "reinforcement" that effectively "knits" the resulting casting material together so that, if minor cracks are encountered, no actual breakage need result. Such reinforcement typically comprises about 2 to 3 percent of the refractory mixture that is used to form castings.

Figure 8:
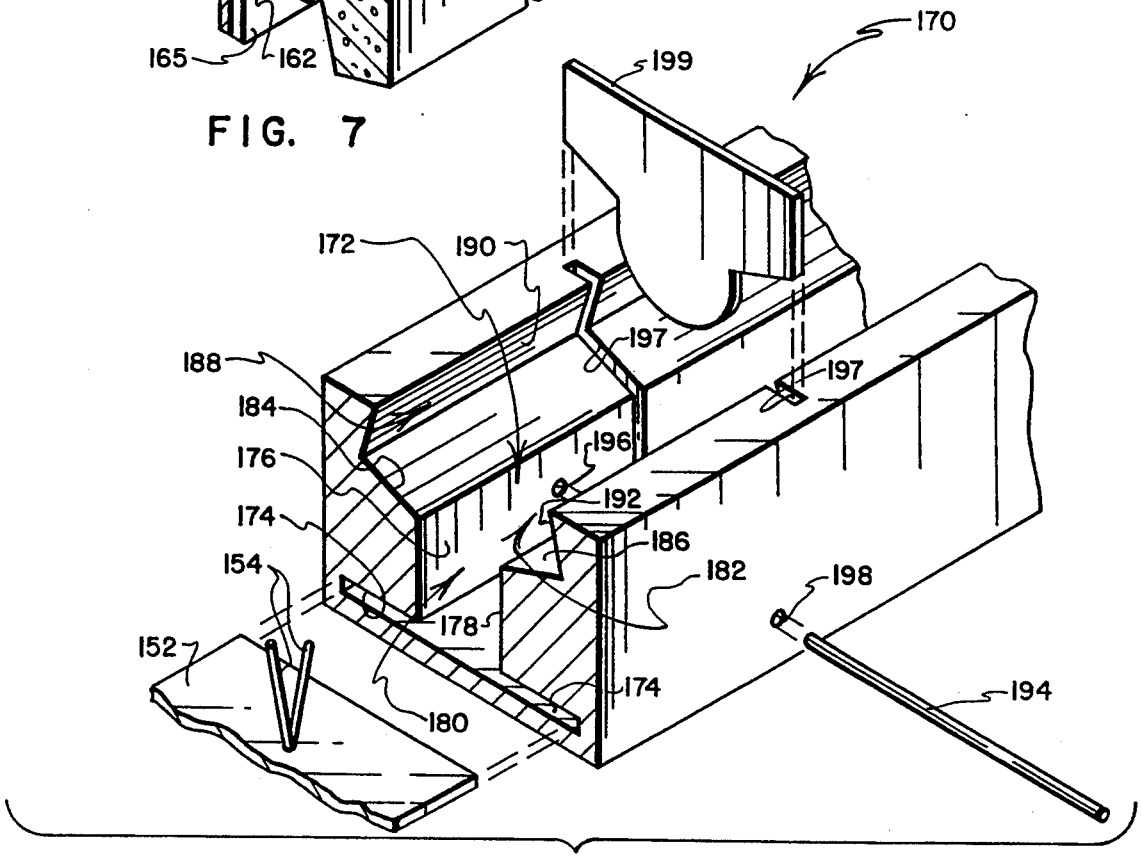
FIG. 8 is a perspective view, on substantially the same scale as FIG. 7, schematically depicting portions of a mold assembly for forming the cast refractory members of FIG. 7, with portions of a steel backing plate and steel reinforcing members welded thereto also being depicted.

Referring to FIG. 8, an elongate steel backing plate 152 that is to be joined with a casting of the refractory material described above is provided with a plurality of generally V-shaped stainless steel reinforcing wires, one of which is depicted and indicated by the numeral 154. The plate 152 is positioned at the bottom of a trough 172 that is defined centrally by the mold 170 (a slot 174 is shown in the schematic view of FIG. 8 as being configured to receive the steel backing plate 152). When so positioned, the V-shaped stainless steel reinforcing wires 154 project upwardly into central portions of the trough 172 (and thence into stem portions 162 of a cast refractory member 150 that is formed in the mold 170). The V-shaped stainless steel wires 154 extend into central parts of the stem portions 162 that are formed as castable refractory sets up between opposed surfaces 176, 178 that define a narrow bottom portion 180 of the trough 172. Located above the narrow bottom portion 180 is a tapered trough portion 182 that is bordered by opposed, inclined surfaces 184, 186 that spread progressively farther apart as they extend away from the bottom portion 180. Joining with the upper end of the tapered portion 182 is a top trough portion 188 bounded by opposed surfaces 190, 192 that are inclined slightly inwardly toward each other as they approach the open top of the trough 182.

At predetermined spaced locations along the bottom portion 180 of the trough 172, aligned holes 196, 198 open through the surfaces 176, 178, respectively, to permit wooden dowel pins 194 to be inserted therein to form bolt holes through stem portions 162 of the resulting cast refractory member 150.

At predetermined spaced locations along the trough 172, aligned groove formations 197 are formed in the opposed trough wall portions 176, 178; 184, 186; and 190, 192 for receiving cardboard dividers 199 that serve the function of forming "expansion joints" 153 (see FIG. 7) in the resulting cast refractory member 150.

The casting of refractory material atop the steel plate 152 with the wires 154 extending into the cast refractory material serves the purpose of establishing a rigid mechanical connection between the resulting cast refractory material and the steel plate 152—a bond that is strengthened when the cast refractory material is "fired" so as to dry, set and harden the material of the castable refractory. During the firing process the wooden dowel pins 194 are reduced to ash as are the cardboard dividers 199—whereby, what results is a hardened, tile-like impact-resistant refractory member 150 that has an enlarged formation 189 (formed by being molded between the opposed wall surfaces 184, 186 and 190, 192) located near one end region of its narrow stem 162, a steel mounting plate 152 near the opposite end region of the stem 162, and spaced bolt holes (not shown, but formed by the dowel pins 194) that extend through central portions of the narrow stem 162.

Figure 7:
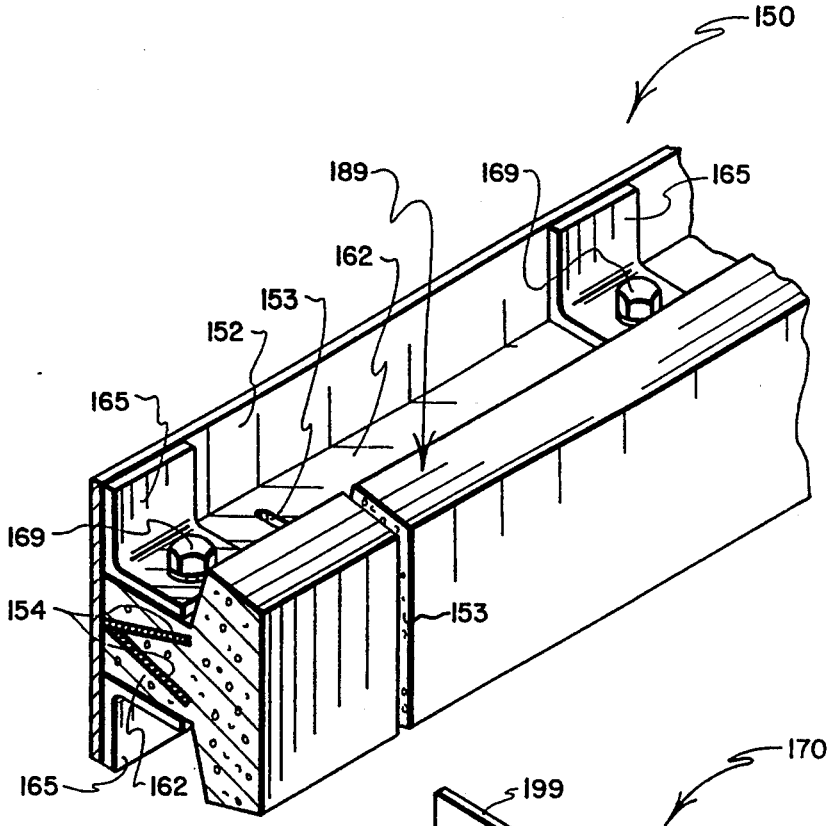
FIG. 7 is a perspective view, on an enlarged scale, showing selected central portions of one of the cast refractory members that is utilized in the first embodiment.

Referring to FIG. 7, to complete the cast refractory assembly 150, pairs of short lengths of angle iron 165 are position along opposite sides of the stem 162, are fastened to the narrow stem by bolts 169, and are securely welded to the steel mounting plate 152. By this arrangement, the mounting plate 152 is quite rigidly connected and anchored to the cast refractory material, and the assembly 150 comprises a very rigid structure that is characterized by a substantially flat refractory surface 167 that extends substantially parallel to the plane of the mounting plate 152 but on the opposite side of the assembly 150 therefrom.

In a manner much akin to the manner in which the members 150 are formed, a specially configured set of "cap" members 145 are cast from refractory material and are anchored to inset pieces of steel to facilitate the mounting of the cap members 145 atop the frame 110. Referring to FIG. 5, the top of the stack 140 is capped by these specially configured cast refractory members 145. Just as the members 150 are formed in molds that define suitable cross-sections, the members 145 likewise are formed in suitably configured molds (not shown) and are cast in situ about steel sleeves 146 (shown only in FIG. 5) that have V-shaped stainless steel reinforcing wires 147 welded thereto. To fasten the cap members 145 in place atop the frame 110, bolts 148 extend through the sleeves 146 and through a plurality of support plates 149. The support plates 149 (best seen in FIGS. 1 and 5) are rigidly connected to the top member 111 of the frame 110 as by welding or by using suitably configured fasteners (not shown).

Figure 6:
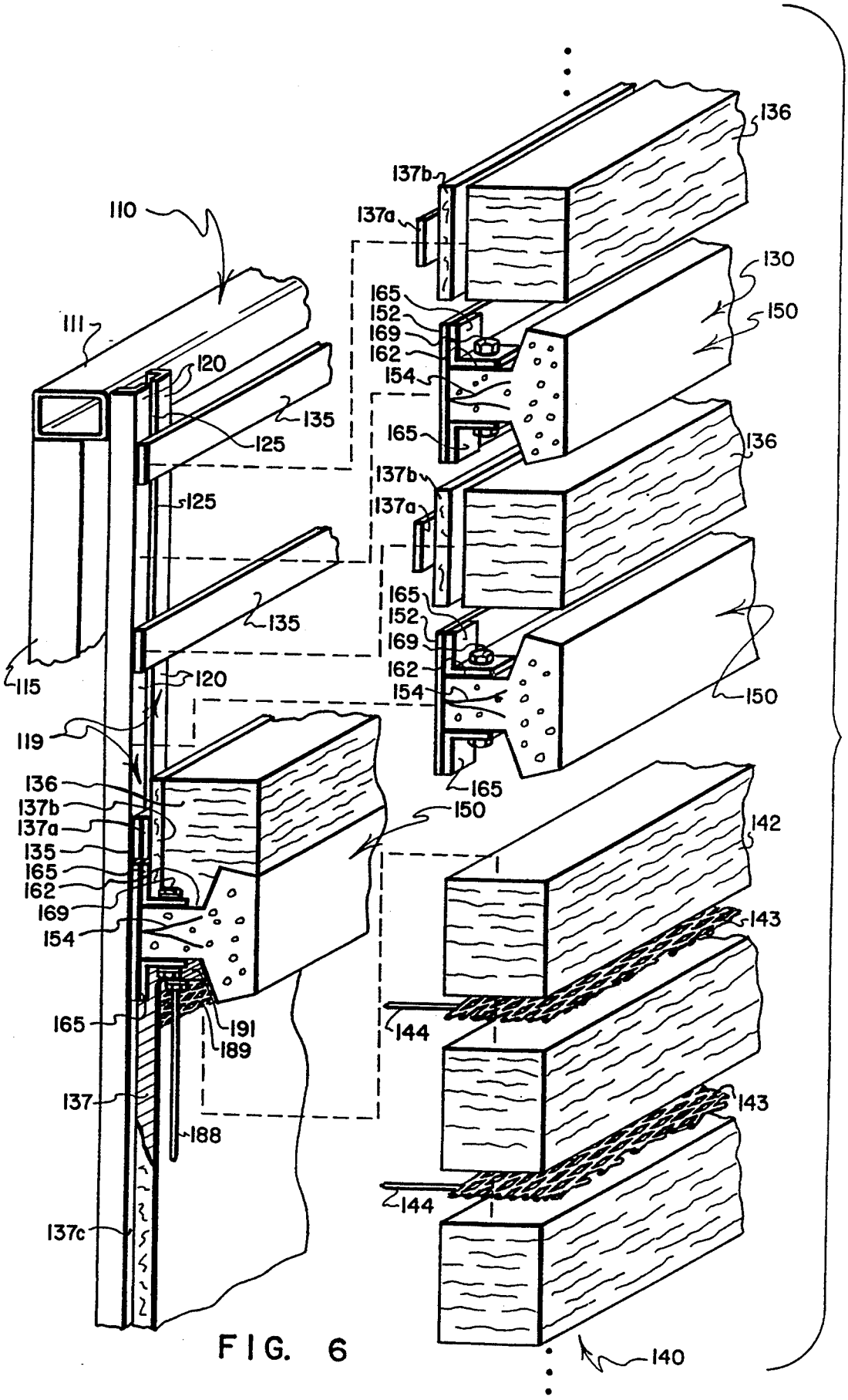
FIG. 6 is an exploded perspective view depicting selected components of the first embodiment.

Referring to FIG. 5, the bottom of the stack 140 is capped by curved plate structure 141 that clampingly engages (so as to compressively retain) a set of log-like formations 142 of fiber-type refractory that defines lower portions of the interior surface 130. Referring to FIGS. 5 and 6, it will be seen that sheets of expanded metal 143 (to which threaded rods 144 have been welded at spaced intervals) are inserted between selected ones of the log-like formations 142. A blanket of fiber-type insulation 137 and/or thin pieces of hardboard, fiber-type insulation **137*c* is/are positioned to extend along aligned exterior surface portions of the stacked array of log-like formations 142. The threaded rods 144 extend through the outer insulation 137 and/or 137*c*, through the slots 125 formed between the paired angle irons 119, and are secured by using conventional nuts and washers (indicated generally by the numeral 138 in FIG. 5**).

Referring to FIG. 6, the process of assembling and connecting the various components of the stack 140 to the frame 110 is depicted somewhat schematically. The process preferably is begun by welding a spaced array of bars of steel 135 (typically steel that is about ⅛ inch to about ¼ inch thick, and about 2 inches in width) to the mounting surfaces 120 of the angle irons 119, with spaces (typically of about 8½ inches in height) being left between the bars 135 to permit the steel mounting plates 152 of the cast refractory assemblies 150 to be positioned one-at-a-time into weldable engagement with the mounting surfaces 120. The lowermost one of the cast refractory assemblies 150 is the first to be put in place with its mounting plate 152 being temporarily clamped in firm surface-to-surface engagement with each of the mounting surfaces 120 of the angle irons 119 while rigid connections are formed therebetween.

In preferred practice the mounting plate 152 is fastened as by welding to the angle irons 119. However, any of a wide variety of fastening techniques other than welding can be used to securely connect the lowermost and others of the cast refractory assemblies 150 to the angle irons 119. While the selection of welding as a fastening technique to connect the cast refractory assemblies 150 to the angle irons 119 may give the impression that the resulting insulated panel 100 can not be disassembled (as by removing one or more of the cast refractory assemblies 150 and/or log-like bodies of fiber-type insulation 136 that are compressively clamped between adjacent ones of the refractory assemblies, as will be described shortly), such is not the case. The welds that are formed between the mounting plates 152 and the angle irons 119 are strong and secure, but can be severed relatively easily using a cutting torch—whereby the welds that mount the cast refractory assemblies 150 on the angle irons 119 should most properly be viewed as comprising "removable" or "releasable" fastenings.

With the lowermost of the cast refractory assemblies 150 securely connected to the frame 110, other components of the stack 140 (i.e., components that are located above and below the one mounted assembly 150) are put in place. If upwardly extending components are next to be put in place, this part of the assembly process is initiated by positioning one or more log-like members 136 of fiber-type refractory atop the one frame-connected assembly 150. Also, relatively rigid panels of resin-bonded fiber-type hardboard insulation **137*a*, 137*b* are interposed between outer surfaces of the log-like members 136 and the mounting surfaces 120 of the angle irons 119. The hardboard members 137*a*, 137*b* provide relatively rigid, relatively flat "fillers" that cooperate with the assemblies 150 to define elongate "pockets" (indicated generally by the numeral 139 in FIG. 5) within which the fiber-type insulation logs 136 are "confined." The next-to-be-mounted cast refractory assemblies 150 are positioned and welded in place one-at-a-time atop underlying log-like members 136 that are duly compressed to assume their proper positions within the pockets 139. This process of properly positioning and mounting the various layers of cast refractory members 150, 145 with layers of log-like members 136 interspersed therebetween is continued until it is completed once the cap members 145** are bolted in place.

If desired, inward end regions of the "pockets" 139 (i.e., pocket-like spaces that extend between the enlarged inner end formations of the cast refractory members 150, and between the uppermost of the cast refractory members 150 and the cap member 145) may be filled with refractory mortar **139*a*. The use of refractory mortar 139*a* serves not only to close the "pockets" 139 to minimize the possibility that minuscule pieces of fiber from the logs 136 will become airborne, but also to increase the proportion of the interior surface 130** that is defined by "hard" refractory material that has a capability to store impingent heat energy and re-radiate it.

The matter of installing a compressed stack of logs of fiber-type insulation beneath the lowest of the cast refractory assemblies 150 is begun by welding a plurality of lengths of steel rod 188 (see FIG. 5 wherein one of the lengths of steel rod 188 is depicted) to the short lengths of angle iron 165 that form a part of the downwardly facing features of the lowest of the cast refractory assemblies 150. Also, to assist in holding the blanket of fiber-type insulation 137 in place near its upper end region (i.e., near its position of engagement with stem portions 162 of the lowermost of the cast refractory assemblies 150), an elongate piece of expanded metal 189 is bent so as to be of generally L-shaped cross-section (best seen in FIG. 5), and the L-shaped expanded metal member 189 is welded to each of the rods 188 that extends through selected ones of its openings at spaced locations extending along the underside of the lowermost of the cast refractory members 150 so as to clamp upper end portions of the blanket 137 against the underside of the stem 162 of said lowermost of the members 150.

Thus, in preferred practice, where extensions of the interior surface 130 are to be provided (typically in regions extending below the area where the array of cast refractory members 150 is located) to enable a particular furnace door construction to accommodate and close a particular door opening, it will be understood that the exterior surface(s) of such extended portions of the stack 140 preferably are defined by at least one layer of thin, resin-bonded "hardboard" that contains fiber-type insulation **137*c* and/or by a blanket of fiber-type insulation 137 that is/are positioned to extend along and in engagement with the mounting surfaces 120 of the angle irons 119; and an upper end region 191 of the blanket 137 is turned inwardly to underlie and clampingly engage the stem 162 of the lowermost of the mounted refractory members 150. Log-like bodies of fiber-type insulation 142 then are positioned one at a time so as to be pierced by the rods 188 and/or so as to be clamped between elongate sheets of expanded metal 143 that have outwardly extending threaded rods 144 welded thereto, with the rods 144 extending through the slots 125**, as has been described.

Once the several log-like bottom members of fiber-type insulation 142 are in place, the bottom structure 141 is positioned beneath the bottom of the stack 140 and is forced upwardly such that the log-like members 142 are substantially uniformly compressed. When the bottom structure 141 is in proper position to clampingly compress the log-like members 142 and to thereby cooperate with the expanded metal members 143 to securely retain the log-like members 142 in position, the bottom structure 141 is securely connected to the frame 110 as by welding and/or by using threaded fasteners (not shown); and, washers and nuts (indicated generally by the numeral 138 in FIG. 5) are installed on the threaded rods 144 so that the expanded metal plates 143 are firmly secured in position.

Depending on the character of the use to which a particular insulated panel is put, one or more optional structures may desirably be connected to the frame 110.

Referring to FIGS. 1 and 2, if the door panel 100 is to assist an adjacent but relatively leftwardly located door panel 100' to close a furnace opening, it is desirable that, when the door panel 100' reaches its fully closed position, it sealingly engages the right end region of the adjacent panel 100'. To assist with this, wheeled assemblies 200 may be secured to such structure (not shown) as resides adjacent the lower end of the panel 100 when the panel 100 is in its closed position (illustrated in FIGS. 1–3) for engaging one or more bi-directionally inclined plates 202 that are bracket-mounted on the frame 110. By this arrangement, the insulated panel 100 can be urged to move slightly leftwardly (as viewed in FIGS. 1 and 2) so as to more closely seal a line of juncture (indicated by the letter "J" in FIG. 1) that exists between adjacent end regions of the panels 100, 100'. Also, suitably configured refractory insulation panels 220, 222 may be added to one or more of the opposed end regions of the insulated panels 100, 100' to assist in preventing the loss of heat energy from between adjacent end regions of the panels 100, 100' when the panels 100, 100' are in their closed positions.

Still another panel feature that usually needs to be provided in one form or another is a means of connecting the panel with conventional furnace structure that serves to movably position the panel. While such means are well known and form no part of the present invention, reference is made to FIGS. 1–4 wherein two pairs of upstanding arms 250 are shown connected to the top frame member 111 for facilitating the connection of the first panel embodiment 100 to conventional panel positioning apparatus (not shown). The third panel embodiment 2100 shown in FIG. 12 has similar formations 2250 for such purposes. While no such formations are shown in FIGS. 8–10 that are devoted to the second panel embodiment, those who are skilled in the art readily will understand that such formations can be added to the panel 1100.

Referring briefly to FIG. 9, a second insulated panel embodiment is indicated generally by the numeral 1100, with corresponding features and components of the first and second panel embodiments 100, 1100 being indicated by identical numerals except that they differ by a magnitude of one thousand. The panel 1100 incorporates only two cast refractory members 1150 that are of a slightly different cross-section than the members 150, as is best seen in FIGS. 9 and 10. Moreover, instead of mounting the cast refractory members "inwardly" with respect to an exterior frame structure (as has been described in conjunction with the panel 100), the cast refractory members 1150 are essentially "housed within" and protectively surrounded by a perimetrically extending frame structure 1100.

Referring briefly to FIG. 10, a third insulated panel embodiment is indicated generally by the numeral 2100, with corresponding features and components of the first and third panel embodiments 100, 2100 being indicated by identical numerals except that they differ by a magnitude of two thousand. The panel 2100 incorporates a total of four cast refractory members 2150 that are spaced across the width of the panel 210, with each adjacent pair of the cast refractory members 2150 being separated by a plurality of log-like bodies 2136 of fiber-type refractory insulation. Like the panel 100, the panel 2100 utilizes an exteriorly positioned supporting frame 2110, and positions its compressed stack 2140 of refractory insulation inwardly relative to the location of the frame 2110.

While the preferred practice of the present invention has been described and illustrated herein as being applied to insulated panels 1) that are of substantially rectangular shape, 2) that are designed to extend substantially vertically when cooperating with other structure to assist in minimizing heat loss from a treatment chamber, and 3) that typically are utilized as "closures" to provide access through hearth openings to treatment chambers of steel reheat furnaces, those who are skilled in the art readily will understand that principles of the present invention can be utilized a) to provide insulated panels of a wide variety of configurations other than rectangular, b) to provide insulated panels that extend in other than vertical orientations, and c) to cooperate with structure other than the walls of a steel reheat furnace. By way of but one example, principles of the present invention can be utilized to form circular insulated panels that can be deployed substantially horizontally to overlie and cooperate with the rims of ladles to assist in retaining heat energy within the ladles.

Although the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. A method of forming an assembly of an elongate sheet of steel and an elongate cast refractory member of generally T-shaped cross-section, comprising the steps of:

a) selecting a castable refractory material that, when cast, will form a rigid elongate cast refractory member that will exhibit good service life when exposed to temperatures in excess of 2,000 degrees Fahrenheit;

b) casting said selected castable refractory material so as to mold-form said rigid elongate cast refractory member so that it has a generally T-shaped cross-section that is in direct contact with one side of the sheet of steel;

c) providing reinforcement means that is securely connected to said one side of the sheet of steel and that is configured to extend into and become anchored within the T-shaped cross-section of said rigid elongate cast refractory member;

d) providing at least one bolt hole that extends through the T-shaped cross-section of said rigid elongate cast refractory member in a direction that substantially parallels a plane within which nearby portions of the sheet of steel extend;

e) positioning at least a short length of angle iron so that one of the two right-angle legs of the angle iron is in contact with said one side of the sheet of steel, and so that the other of said legs is intersected by the axis of the bolt hold;

f) providing a hole in the other of the legs with said hole being axially aligned with the bolt hole;

g) installing a bolt in the aligned hole and bolt hole to rigidly connect the angle iron with said rigid elongate cast refractory member; and, h) welding said one of the legs to said one side of the sheet of steel to securely connect the angle iron with the sheet of steel.

2. An assembly of an elongate sheet of steel and an elongate cast refractory member of generally T-shaped cross-section formed by a method comprising the steps of:

a) selecting a castable refractory material that, when cast, will form a rigid elongate cast refractory member that will exhibit good service life when exposed to temperatures in excess of 2,000 degrees Fahrenheit;

b) casting said selected castable refractory material so as to mold-form said rigid elongate cast refractory member so that it has a generally T-shaped cross-section that is in direct contact with one side of the sheet of steel;

c) providing reinforcement means that is securely connected to said one side of the sheet of steel and that is configured to extend into and become anchored within the T-shaped cross-section of said rigid elongate cast refractory member;

d) providing at least one bolt hole that extends through the T-shaped cross-section of said rigid elongate cast refractory member in a direction that substantially parallels a plane within which nearby portions of the sheet of steel extend;

e) positioning at least a short length of angle iron so that one of the two right-angle legs of the angle iron is in contact with said one side of the sheet of steel, and so that the other of the legs is intersected by the axis of the bolt hole;

f) providing a hole in said other of the legs with said hole being axially aligned with the bolt hole;

g) installing a bolt in the aligned hole and bolt hole to rigidly connect the angle iron with said rigid elongate cast refractory member; and, h) welding said one of the legs to said one side of the sheet of steel to securely connect the angle iron with the sheet of steel.

3. The method of claim 1 wherein the step of casting said selected castable refractory material includes the steps of:

a) providing mold means for defining a trough shaped receptacle that has opposed side walls that cooperate to define a cross-section that corresponds to said generally T-shaped configuration of said rigid elongate cast refractory member for receiving said selected castable refractory material within said trough shaped receptacle and for conforming said selected castable refractory material to said generally T-shaped cross-section; and, b) introducing said selected castable refractory material into said trough shaped receptacle between said opposed side walls thereof to mold-form said rigid elongate cast refractory member.

4. The assembly of claim 2 wherein the method of formation of the assembly additionally includes the steps of:

a) providing mold means for defining a trough-shaped receptacle that has opposed side walls that cooperate to define a cross-section that corresponds to said generally T-shaped configuration of said rigid elongate cast refractory member for receiving said selected castable refractory material within said trough shaped receptacle and for conforming said selected castable refractory material to said generally T-shaped cross-section; and, b) introducing said selected castable refractory material into said trough shaped receptacle between said opposed side walls thereof to mold-form said rigid elongate cast refractory member.

5. The method of claim 3 wherein the step of casting said selected castable refractory material includes the step of positioning castable refractory material that is introduced into said trough shaped receptacle in such a way that the resulting configuration that is taken by such castable refractory material defines a substantially flat surface that extends substantially contiguously between the opposed side walls of the trough shaped receptacle and within a plane that substantially parallels said plane within which portions of the sheet of steel extend.

6. The assembly of claim 4 wherein the step of casting said selected castable refractory material includes the step of positioning castable refractory material that is introduced into said trough shaped receptacle in such a way that the resulting configuration that is taken by such castable refractory material defines a substantially flat surface that extends substantially contiguously between the opposed side walls of the trough shaped receptacle and within a plane that substantially parallels said plane within which portions of the sheet of steel extend.

7. The method of claim 3 wherein:

a) the step of providing mold means for defining a trough shaped receptacle includes the step of forming said opposed side walls so that they extend substantially straight and unbending along a length that is sufficient to permit said rigid elongate cast refractory member to be mold-formed therein; and, b) the step of introducing said selected castable refractory material into said trough shaped receptacle to mold-form said selected castable refractory material includes the step of utilizing the substantially straight and unbending character of said opposed side walls of the elongate trough shaped receptacle to mold-form said castable refractory material so that the resulting mold-formed rigid elongate cast refractory member has opposed sides that are substantially straight and unbending along the length of the mold-formed rigid elongate cast refractory member.

8. The assembly of claim 4 wherein:

a) the step of providing mold means for defining a trough shaped receptacle includes the step of forming said opposed side walls so that they extend substantially straight and unbending along a length that is sufficient to permit said rigid elongate cast refractory member to be mold-formed therein; and, b) the step of introducing said selected castable refractory material into said trough shaped receptacle to mold-form said selected castable refractory material includes the step of utilizing the substantially straight and unbending character of said opposed side walls of the elongate trough shaped receptacle to mold-form said castable refractory material so that the resulting mold-formed rigid elongate cast refractory member has opposed sides that are substantially straight and unbending along the length of the mold-formed rigid elongate cast refractory member.

9. The method of claim 3 wherein;

a) the step of providing mold means for defining a trough shaped receptacle includes the step of providing a set of aligned grooves in said opposed side walls at a selected location along the length of the trough shaped receptacle; and, b) the step of casting said selected refractory material so as to mold-form said rigid elongate cast refractory member includes the step of forming a groove shaped expansion joint n said rigid elongate cast refractory member at said selected location along the length of the trough shaped receptacle by 1) inserting a thin divider member into the trough shaped receptacle at said selected location with opposite end regions of the divider member extending into said set of aligned grooves, and with portions of the divider member that extend between said opposed end regions being positioned to extend across at least a selected portion of the trough shaped receptacle, 2) casting said selected refractory material closely about opposite sides of the divider member as said rigid elongate cast refractory member is being mold-formed within said trough shaped receptacle, and 3) removing the divider member from the resulting mold-formed rigid elongate cast refractory member so that a groove shaped expansion joint is defined that extends between opposite side portions of the rigid elongate cast refractory member at the location where said divider member has been removed.

10. The assembly of claim 4 wherein:

a) the step of providing mold means for defining a trough shaped receptacle includes the step of providing a set of aligned grooves in said opposed side walls of a selected location along the length of the trough shaped receptacle; and, b) the step of casting said selected refractory material so as to mold-form said rigid elongate cast refractory member includes the step of forming a groove-like expansion joint in said rigid elongate cast refractory member at said selected location along the length of the trough shaped receptacle by 1) inserting a thin divider member into the trough shaped receptacle at said selected location with opposite end regions of the divider member extending into said set of aligned grooves, and with portions of the divider member that extend between said opposed end regions being positioned to extend across at least a selected portion of the trough shaped receptacle, 2) casting said selected refractory material closely about opposite sides of the divider member as said rigid elongate cast refractory member is being mold-formed within said trough shaped receptacle, and 3) removing the divider member from the resulting mold-formed rigid elongate cast refractory member so that a groove shaped expansion joint is defined that extends between opposite side portions of the rigid elongate cast refractory member at the location where said divider member has been removed.

11. The method of claim 3 wherein:

a) the step of providing mold means for defining a trough shaped receptacle includes the step of positioning within the trough shaped receptacle an elongate member that extends between said opposed side walls of the trough shaped receptacle along a path that is to be followed by the bolt hole that is to be provided through the T-shaped cross-section of said rigid elongate cast refractory member;

b) the step of casting said selected refractory material so as to mold-form said rigid elongate cast refractory member includes the step of casting said selected refractory material closely about said elongate member as the selected castable refractory material is introduced into said trough shaped receptacle to mold-form said rigid elongate cast refractory member; and, c) the step of providing said bolt hole includes the step of removing said elongate member that extends through the T-shaped cross-section of the resulting mold-formed rigid elongate cast refractory member so that said bolt hole is defined at the location where said elongate member has been removed.

12. The assembly of claim 4 wherein:

a) the step of providing mold means for defining a trough shaped receptacle includes the step of positioning with the trough shaped receptacle an elongate member that extends between said opposed side walls of the trough shaped receptacle along a path that is to be followed by the bolt hole that is to be provided through the T-shaped cross-section of said rigid elongate cast refractory member;

b) the step of casting said selected refractory material so as to mold-form said rigid elongate cast refractory member includes the step of casting said selected refractory material closely about said elongate member as the selected castable refractory material is introduced into said trough shaped receptacle to mold-form said rigid elongate cast refractory member; and, c) the step of providing said bolt hole includes the step of removing said elongate member that extends through the T-shaped cross-section of the resulting mold-formed rigid elongate cast refractory member so that said bolt hole is defined at the location where said elongate member has been removed.

13. The method of claim 11 wherein:

a) the step of providing an elongate member that extends between said opposed side walls of the trough shaped receptacle along a path that is to be followed by the bolt hole that is to be provided through the T-shaped cross-section of said rigid elongate cast refractory member includes the step of inserting a wood dowel pin to extend between said opposed side walls to define said elongate member; and, b) the step of removing said elongate member that extends through the T-shaped cross-section of the resulting mold-formed rigid elongate cast refractory member so that said bolt hole is defined at the location where said elongate member has been removed includes the step of removing the wood dowel pin so that it no longer extends along the path that is to be followed by the bolt hole.

14. The assembly of claim 12 wherein:

a) the step of providing an elongate member that extends between said opposed side walls of the trough shaped receptacle along a path that is to be followed by the bolt hole that is to be provided through the T-shaped cross-section of said rigid elongate cast refractory member includes the step of inserting a wood dowel pin to extend between said opposed side walls to define said elongate member; and, b) the step of removing said elongate member that extends through the T-shaped cross-section of the resulting mold-formed rigid elongate cast refractory member so that said bolt hole is defined at the location where said elongate member has been removed includes the step of removing the wood dowel pin so that it no longer extends along the path that is to be followed by the bolt hole.

15. A method of forming an assembly of an elongate sheet of steel and an elongate cast refractory member of generally T-shaped cross-section, comprising the steps of:

a) selecting a castable refractory material that, when cast, will form a rigid elongate cast refractory member that will exhibit good service life when exposed to temperatures in excess of 2,000 degrees Fahrenheit;

b) casting said selected castable refractory material so as to mold-form said rigid elongate cast refractory member so that it has a generally T-shaped cross-section that is in direct contact with one side of the sheet of steel;

c) providing reinforcement means that is securely connected to said one side of the sheet of steel and that is configured to extend into and become anchored within the T-shaped cross-section of said rigid elongate cast refractory member;

d) providing at least one passage that extends through the T-shaped cross-section of said rigid elongate cast refractory member in a direction that substantially parallels a plane within which nearby portions of the sheet of steel extend, with said passage opening through a side surface portion of said rigid elongate cast refractory member;

e) providing rigid structural support means for being rigidly connected both to the sheet of steel and to the T-shaped cross-section of the rigid elongate cast refractory member, including a length of rigid material that defines:

i) a first surface portion that is positioned to extend along and in contact with said one side of the sheet of steel;

ii) a second surface portion that is positioned to extend along and in contact with said side surface portion of said rigid elongate cast refractory member; and, iii) a hole formed through said second surface portion and extending in alignment with the passage that is formed through said rigid elongate cast refractory member;

f) rigidly connecting the length of rigid material to the rigid elongate cast refractory member by installing fastening means to extend through said aligned hole and passage; and, g) rigidly connecting the length of rigid material to the sheet of steel.

16. An assembly of an elongate sheet of steel and an elongate cast refractory member of generally T-shaped cross-section formed in accordance with a method comprising of the steps of:

a) selecting a castable refractory material that, when cast, will form a rigid elongate cast refractory member that will exhibit good service life when exposed to temperatures in excess of 2,000 degrees Fahrenheit;

b) casting said selected castable refractory material so as to mold-form said rigid elongate cast refractory member so that is has a generally T-shaped cross-section that is in direct contact with one side of the sheet of steel;

c) providing reinforcement means that is securely connected to said one side of the sheet of steel and that is configured to extend into and become anchored within the T-shaped cross-section of said rigid elongate cast refractory member;

d) providing at least one passage that extends through the T-shaped cross-section of said rigid elongate cast refractory member in a direction that substantially parallels a plane within which nearby portions of the sheet of steel extend, with said passage opening through a side surface portion of said rigid elongate cast refractory member;

e) providing rigid structural support means for being rigidly connected both to the sheet of steel and to the T-shaped cross-section of the rigid elongate cast refractory member, including a length of rigid material that defines:

i) a first surface portion that is positioned to extend along and in contact with said one side of the sheet of steel;

ii) a second surface portion that is positioned to extend along and in contact with said side surface portion of said rigid elongate cast refractory member; and, iii) a hole formed through said second surface portion and extending in alignment with the passage that is formed through said rigid elongate cast refractory member;

f) rigidly connecting the length of rigid material to the rigid elongate cast refractory member by installing fastening means to extend through said aligned hole and passage; and, g) rigidly connecting the length of rigid material to the sheet of steel.

17. The method of claim 15 wherein the step of casting said selected castable refractory material includes the steps of:

a) providing mold means for defining a trough shaped receptacle that has opposed side walls that cooperate to define a cross-section that corresponds to said generally T-shaped configuration of said rigid elongate cast refractory member for receiving said selected castable refractory material within said trough shaped receptacle and for conforming said selected castable refractory material to said generally T-shaped cross-section; and, b) introducing said selected castable refractory material into said trough shaped receptacle between said opposed side walls thereof to mold-form said rigid elongate cast refractory member.

18. The assembly of claim 16 wherein the step of casting said selected castable refractory material includes the steps of:

a) providing mold means for defining a trough-like receptacle that has opposed side walls that cooperate to define a cross-section that corresponds to said generally T-shaped configuration of said rigid elongate cast refractory member for receiving said selected castable refractory material within said trough shaped receptacle and for conforming said selected castable refractory material to said generally T-shaped cross-section; and, b) introducing said selected castable refractory material into said trough shaped receptacle between said opposed side walls thereof to mold-form said rigid elongate cast refractory member.

19. The method of claim 17 wherein the step of casting said selected castable refractory material includes the step of positioning castable refractory material that is introduced into said trough shaped receptacle in such a way that the resulting configuration that is taken by such castable refractory material defines a substantially flat surface that extends substantially contiguously between the opposed side walls of the trough shaped receptacle and within a plane that substantially parallels said plane within which portions of the sheet of steel extend.

20. The assembly of claim 18 wherein the step of casting said selected castable refractory material includes the step of positioning castable refractory material that is introduced into said trough shaped receptacle in such a way that the resulting configuration that is taken by such castable refractory material defines a substantially flat surface that extends substantially contiguously between the opposed side walls of the trough shaped receptacle and within a plane that substantially parallels said plane within which portions of the sheet of steel extend.

21. The method of claim 17 wherein:

a) the step of providing mold means for defining a trough shaped receptacle includes the step of forming said opposed side walls so that they extend substantially straight and unending along a length that is sufficient to permit said rigid elongate cast refractory member to be mold-formed therein; and, b) the step of introducing said selected castable refractory material into said trough shaped receptacle to mold-form said selected castable refractory material includes the step of utilizing the substantially straight and unbending character of said opposed side walls of the elongate trough shaped receptacle to mold-form said castable refractory material so that the resulting mold-formed rigid elongate cast refractory member has opposed sides that are substantially straight and unbending along the length of the mold-formed rigid elongate cast refractory member.

22. The assembly of claim 18 wherein:

a) the step of providing mold means for defining a trough shaped receptacle includes the step of forming said opposed side walls so that they extend substantially straight and unbending along a length that is sufficient to permit said rigid elongate cast refractory member to be mold-formed therein; and, b) the step of introducing said selected castable refractory material into said trough shaped receptacle to mold-form said selected castable refractory material includes the step of utilizing the substantially straight and unbending character of said opposed side walls of the elongate trough shaped receptacle to mold-form said castable refractory material so that the resulting mold-formed rigid elongate cast refractory member has opposed sides that are substantially straight and unbending along the length of the mold-formed rigid elongate cast refractory member.

23. The method of claim 17 wherein:

a) the step of providing mold means for defining a trough shaped receptacle includes the step of providing a set of aligned grooves in said opposed side walls at a selected location along the length of the trough shaped receptacle; and, b) the step of casting said selected refractory material so as to mold-form said rigid elongate cast refractory member includes the step of forming a groove-like expansion joint in said rigid elongate cast refractory member at said selected location along the length of the trough shaped receptacle by 1) inserting a thin, flat divider member into the trough shaped receptacle at said selected location with opposite end regions of the divider member extending into said set of aligned grooves, and with the divider member extending across at least a selected portion of the trough shaped receptacle, 2) casting said selected refractory material closely about opposite sides of the thin, flat divider member as said rigid elongate cast refractory member is being mold-formed within said trough shaped receptacle, and 3) removing the divider member from the resulting mold-formed rigid elongate cast refractory member so that a groove shaped expansion joint is defined to extend between opposite side portions of the rigid elongate cast refractory member at the location where said divider has been removed.

24. The assembly of claim 18 wherein:

a) the step of providing mold means for defining a trough shaped receptacle includes the step of providing a set of aligned grooves in said opposed side walls at a selected location along the length of the trough shaped receptacle; and, b) the step of casting said selected refractory material so as to mold-form said rigid elongate cast refractory member includes the step of forming a groove-like expansion joint in said rigid elongate cast refractory member at said selected location along the length of the trough shaped receptacle by 1) inserting a thin, flat divider member into the trough shaped receptacle at said selected location with opposite end regions of the divider member extending into said set of aligned grooves, and with the divider member extending across at least a selected portion of the trough shaped receptacle, 2) casting said selected refractory material closely about opposite sides of the thin, flat divider member as said rigid elongate cast refractory member is being mold-formed within said trough shaped receptacle, and 3) removing the divider member from the resulting mold-formed rigid elongate cast refractory member so that a groove shaped expansion joint is defined to extend between opposite side portions of the rigid elongate cast refractory member at the location where said divider has been removed.

25. The method of claim 17 wherein:

a) the step of providing mold means for defining a trough-like receptacle includes the step of positioning within the trough-like receptacle an elongate member that extends between opposite sides of the trough-like receptacle along a path that is to be followed by the passage that is to be provided through the T-shaped cross-section of said rigid elongate cast refractory member;

b) the step of casting said selected refractory material so as to mold-form said rigid elongate cast refractory member includes the step of casting said selected refractory material closely about said elongate member as the selected castable refractory material is introduced into said trough-like receptacle to mold-form said rigid elongate cast refractory member; and, c) the step of providing said passage includes the step of removing said elongate member that extends through the T-shaped cross-section of the resulting mold-formed rigid elongate cast refractory member so that said passage is defined at the location where said elongate member has been removed.

26. The assembly of claim 18 wherein:

a) the step of providing mold means for defining a trough shaped receptacle includes the step of positioning within the trough shaped receptacle an elongate member that extends between opposite sides of the trough shaped receptacle along a path that is to be followed by the passage that is to be provided through the T-shaped cross-section of said rigid elongate cast refractory member;

b) the step of casting said selected refractory material so as to mold-form said rigid elongate cast refractory member includes the step of casting said selected refractory material closely about said elongate member as the selected castable refractory material is introduced into said trough shaped receptacle to mold-form said rigid elongate cast refractory member; and, c) the step of providing said passage includes the step of removing said elongate member that extends through the T-shaped cross-section of the resulting mold-formed rigid elongate cast refractory member so that said passage is defined at the location where said elongate member has been removed.

27. The method of claim 25 wherein:

a) the step of providing an elongate member that extends between opposite sides of the trough shaped receptacle along a path that is to be followed by said passage that is to be provided through the T-shaped cross-section of said rigid elongate case refractory member includes the step of using a wood dowel pin to define said elongate member; and, b) the step of removing said elongate member that extends through the T-shaped cross-section of the resulting mold-formed rigid elongate cast refractory member so that said passage is defined at the location where said elongate member has been removed includes the step of removing the wood dowel pin so that is no longer extends along the path that is to be followed by said passage.

28. The assembly of claim 26 wherein:

a) the step of providing an elongate member that extends between opposite sides of the trough shaped receptacle along a path that is to be followed by said passage that is to be provided through the T-shaped cross-section of said rigid elongate cast refractory member includes the step of using a wood dowel pin to define said elongate member; and, b) the step of removing said elongate member that extends through the T-shaped cross-section of the resulting mold-formed rigid elongate cast refractory member so that said passage is defined at the location where said elongate member has been removed includes the step of removing the wood dowel pin so that it no longer extends along the path that is to be followed by said passage.

29. A method of providing a heat-insulating lining for a panel frame, comprising the steps of:

a) forming a plurality of elongate assemblies that each include a sheet of steel and elongate cast refractory member of generally T-shaped cross-section, and that each are formed by carrying out the following steps:

i) selecting a castable refractory material that, when cast, will form a rigid elongate cast refractory member that will exhibit good service life when exposed to temperatures in excess of 2,000 degrees Fahrenheit;

ii) casting said selected castable refractory material so as to mold-form said rigid elongate cast refractory member so that it has a generally T-shaped cross-section that is in direct contact with one side of the sheet of steel;

iii) providing reinforcement means that is securely connected to said one side of the sheet of steel and that is configured to extend into and become anchored within the T-shaped cross-section of said rigid elongate cast refractory member;

iv) providing at least one bolt hole that extends through the T-shaped cross-section of said rigid elongate cast refractory member in a direction that substantially parallels a plane within which nearby portions of the sheet of steel extend;

v) positioning at least a short length of angle iron so that one of the two right-angle legs of the angle iron is in contact with said one side of the sheet of steel, and so that the other of the legs is intersected by the axis of the bolt hole;

vi) providing a hole in said other of the legs with said hole being axially aligned with the bolt hole;

vii) installing a bolt in the aligned hole and bolt hole to rigidly connect the angle iron with said rigid elongate case refractory member; and, viii) welding said one of the legs to said one side of the sheet of steel to securely connect the angle iron with the sheet of steel;

b) mounting the plurality of elongate assemblies on a frame as by establishing secure connection between the sheets of steel and the frame so that the elongate assemblies extend in spaced, substantially parallel, side-by-side relationship with spaces being defined between adjacent ones of the assemblies; and, c) positioning elongate bodies of fiber refractory material to extend within the spaces that extend between adjacent pairs of the elongate assemblies.

30. A heat-insulating lining for a panel frame formed in accordance with a method comprising the steps of:

a) forming a plurality of elongate assemblies that each include a sheet of steel and elongate cast refractory member of generally T-shaped cross-section, and that each are formed by carrying out the following steps:

i) selecting a castable refractory material that, when cast, will form a rigid elongate cast refractory member that will exhibit good service life when exposed to temperatures in excess of 2,000 degrees Fahrenheit;

ii) casting said selected castable refractory material so as to mold-form said rigid elongate cast refractory member so that it has a generally T-shaped cross-section that is in direct contact with one side of the sheet of steel;

iii) providing reinforcement means that is securely connected to said one side of the sheet of steel and that is configured to extend into and become anchored within the T-shaped cross-section of said rigid elongate cast refractory member;

iv) providing at least one bolt hole that extends through the T-shaped cross-section of said rigid elongate cast refractory member in a direction that substantially parallels a plane within which nearby portions of the sheet of steel extend;

v) positioning at least a short length of angle iron so that one of the two right-angle legs of the angle iron is in contact with said one side of the sheet of steel, and so that the other of the legs is intersected by the axis of the bolt hole;

vi) providing a hole in said other of the legs with said hole being axially aligned with the bolt hole;

vii) installing a bolt in the aligned hole and bolt hole to rigidly connect the angle iron with said rigid elongate cast refractory member; and, viii) welding said one of the legs to said one side of the sheet of steel to securely connect the angle iron with the sheet of steel;

b) mounting the plurality of elongate assemblies on a frame as by establishing secure connections between the sheets of steel and the frame so that the elongate assemblies extend in spaced, substantially parallel, side-by-side relationship with spaces being defined between adjacent ones of the assemblies; and, c) positioning elongate bodies of fiber refractory material to extend within the spaces that extend between adjacent pairs of the elongate assemblies.

31. The method of claim 29 wherein the step of positioning elongate bodies of fiber refractory material includes the steps 1) of providing elongate bodies of fiber refractory material that normally are of sizes that are larger than are the sizes of the spaces that extend between adjacent pairs of the elongate assemblies, and 2) of compressing the elongate bodies of fiber refractory material so as to fit the elongate bodies of fiber refractory material into the spaces that extend between adjacent pairs of the elongate assemblies.

32. The heat-insulating lining for a panel frame of claim 30 wherein the step of positioning elongate bodies of fiber refractory material includes the steps 1) of providing elongate bodies of fiber refractory material that normally are of sizes that are larger than are the sizes of the spaces that extend between adjacent pairs of the elongate assemblies, and 2) of compressing the elongate bodies of fiber refractory material so as to fit the elongate bodies of fiber refractory material into the spaces that extend between adjacent pairs of the elongate assemblies.

33. A method of providing a heat-insulating lining for a panel frame, comprising the steps of:

a) forming a plurality of elongate assemblies that each include a sheet of steel and elongate cast refractory member of generally T-shaped cross-section, and that each are formed by carrying out the following steps:

i) selecting a castable refractory material that, when cast, will form a rigid elongate cast refractory member that will exhibit good service life when exposed to temperatures in excess of 2,000 degrees Fahrenheit;

ii) casting said selected castable refractory material so as to mold-form said rigid elongate cast refractory member so that it has a generally T-shaped cross-section that is in direct contact with one side of the sheet of steel;

iii) providing reinforcement means that is securely connected to said one side of the sheet of steel and that is configured to extend into and become anchored within the T-shaped cross-section of said rigid elongate cast refractory member;

iv) providing at least one passage that extends through the T-shaped cross-section of said rigid elongate cast refractory member in a direction that substantially parallels a plane within which nearby portions of the sheet of steel extend, with said passage opening through a side surface portion of said rigid elongate case refractory member;

v) providing rigid structural support means for being rigidly connected both to the sheet of steel and to the T-shaped cross-section of the rigid elongate cast refractory member, including a length of rigid material that defines:

1) a first surface portion that is positioned to extend along and in contact with said one side of the sheet of steel;

2) a second surface portion that is positioned to extend along and in contact with said side surface portion of said rigid elongate cast refractory member; and, 3) a hole formed through said second surface portion and extending in alignment with the passage that is formed through said rigid elongate cast refractory member;

vi) rigidly connecting the length of rigid material to the rigid elongate cast refractory member by installing fastening means to extend through said aligned hole and passage; and, vii) rigidly connecting the length of rigid material to the sheet of steel;

b) mounting the plurality of elongate assemblies on a frame as by establishing secure connections between the sheets of steel and the frame so that the elongate assemblies extend in spaced, substantially parallel, side-by-side relationship with spaces being defined between adjacent ones of the assemblies; and, c) positioning elongate bodies of fiber refractory material to extend within the spaces that extend between adjacent pairs of the elongate assemblies.

34. A heat-insulating lining for a panel frame formed in accordance with a method comprising the steps of:

a) forming a plurality of elongate assemblies that each include a sheet of steel and elongate cast refractory member of generally T-shaped cross-section, and that each are formed by carrying out the following steps:

i) selecting a castable refractory material that, when cast, will form a rigid elongate cast refractory member that will exhibit good service life when exposed to temperatures in excess of 2,000 degrees Fahrenheit;

ii) casting said selected castable refractory material so as to mold-form said rigid elongate cast refractory member so that it has a generally T-shaped cross-section that is in direct contact with one side of the sheet of steel;

iii) providing reinforcement means that is securely connected to said one side of the sheet of steel and that is configured to extend into and become anchored within the T-shaped cross-section of said rigid elongate cast refractory member;

iv) providing at least one passage that extends through the T-shaped cross-section of said rigid elongate cast refractory member in a direction that substantially parallels a plane within which nearby portions of the sheet of steel extend, with said passage opening through a side surface portion of said rigid elongate cast refractory member;

v) providing rigid structural support means for being rigidly connected both to the sheet of steel and to the T-shaped cross-section of the rigid elongate cast refractory member, including a length of rigid material that defines:
1) a first surface portion that is positioned to extend along and in contact with said one side of the sheet of steel;
2) a second surface portion that is positioned to extend along and in contact with said side surface portion of said rigid elongate cast refractory member; and,
3) a hole formed through said second surface portion and extending in alignment with the passage that is formed through said rigid elongate cast refractory member;
vi) rigidly connecting the length of rigid material to the rigid elongate cast refractory member by installing fastening means to extend through said aligned hole and passage; and,
vii) rigidly connecting the length of rigid material to the sheet of steel;
b) mounting the plurality of elongate assemblies on a frame as by establishing secure connections between the sheets of steel and the frame so that the elongate assemblies extend in spaced, substantially parallel, side-by-side relationship with spaces being defined between adjacent ones of the assemblies; and,
c) positioning elongate bodies of fiber refractory material to extend within the spaces that extend between adjacent pairs of the elongate assemblies.

35. The method of claim 33 wherein the step of positioning elongate bodies of fiber refractory material includes the steps 1) of providing elongate bodies of fiber refractory material that normally are of sizes that are larger than are the sizes of the spaces that extend between adjacent pairs of the elongate assemblies, and 2) of compressing the elongate bodies of fiber refractory material so as to fit the elongate bodies of fiber refractory material into the spaces that extend between adjacent pairs of the elongate assemblies.

36. The heat-insulating lining for a panel frame of claim 34 wherein the step of positioning elongate bodies of fiber refractory material includes the steps 1) of providing elongate bodies of fiber refractory material that normally are of sizes that are larger than are the sizes of the spaces that extend between adjacent pairs of the elongate assemblies, and 2) of compressing the elongate bodies of fiber refractory material so as to fit the elongate bodies of fiber refractory material into the spaces that extend between adjacent pairs of the elongate assemblies.

37. A method of forming an insulated wall panel for use in minimizing the loss of heat energy from the treatment chamber of a high temperature furnace extending about selected peripheral portions of the treatment chamber so as to receive and store some impingent heat energy that is received from the treatment chamber, and by reradiating some of the stored heat energy back into the treatment chamber comprising the steps of:
a) providing frame means for defining a rigid support structure that is positionable to extend along selected portions of the periphery of a treatment chamber of a high temperature furnace, with the thus-positioned rigid support structure having inwardly facing portions that face generally toward the treatment chamber in an "inward" direction, and having outwardly facing portions that face generally away from the treatment chamber in an "outward" direction;
b) connecting insulation means to the frame means so that a body of insulation is provided that has an interior surface that overlies and faces inwardly along said selected portions of the periphery of a treatment chamber to diminish loss of heat energy from the treatment chamber; and,
c) with the step of connecting the insulation means including the step of connecting a plurality of rigid, elongate assemblies that each include a sheet of steel and an elongate body of cast refractory material of generally T-shaped cross-section, with the elongate assemblies being arranged in spaced, side-by-side relationship for defining a major part of said interior surface, and for imparting to the interior surface a capability to receive and store impingent heat energy from the treatment chamber and to re-radiate stored heat energy back into the treatment chamber, and with each of the elongate assemblies being formed by carrying out the following steps:
i) selecting a castable refractory material that, when cast, will form a rigid elongate cast refractory member that will exhibit good service life when exposed to temperatures in excess of 2,000 degrees Fahrenheit;
ii) casting said selected castable refractory material so as to mold-form said rigid elongate cast refractory member so that is has a generally T-shaped cross-section that is in direct contact with one side of the sheet of steel;
iii) providing reinforcement means that is securely connected to said one side of the sheet of steel and that is configured to extend into and become anchored within the T-shaped cross-section of said rigid elongate cast refractory member;
iv) providing at least one bolt hole that extends through the T-shaped cross-section of said rigid elongate cast refractory member in a direction that substantially parallels a plane within which nearby portions of the sheet of steel extend;
v) positioning at least a short length of angle iron so that one of the two right-angle legs of the angle iron is in contact with said one side of the sheet of steel, and so that the other of the legs is intersected by the axis of the bolt hole;
vi) providing a hole in said other of the legs with said hole being axially aligned with the bolt hole;
vii) installing a bolt in the aligned hole and bolt hole to rigidly connect the angle iron with said rigid elongate cast refractory member; and,
viii) welding said one of the legs to said one side of the sheet of steel to securely connect the angle iron with the sheet of steel.

38. An insulated wall panel for use in minimizing the loss of heat energy from the treatment chamber of a high temperature furnace extending about selected peripheral portions of the treatment chamber so as to receive and store some impingent heat energy that is received from the treatment chamber, and by re-radiating some of the stored heat energy back into the treatment chamber, wherein the insulated wall panel is formed in accordance with a method comprising the steps of:
a) providing frame means for defining a rigid support structure that is positionable to extend along selected portions of the periphery of a treatment chamber of a high temperature furnace, with the thus-positioned rigid support structure having inwardly facing portions that face generally toward the treatment chamber in an "inward" direction, and having outwardly facing portions that face generally away from the treatment chamber in an "outward" direction;

b) connecting insulation means to the frame means so that a body of insulation is provided that has an interior surface that overlies and faces inwardly along said selected portions of the periphery of a treatment chamber to diminish loss of heat energy from the treatment chamber; and, c) with the step of connecting the insulation means including the step of connecting a plurality of rigid, elongate assemblies that each include a sheet of steel and an elongate body of cast refractory material of generally T-shaped cross-section, with the elongate assemblies being arranged in spaced, side-by-side relationship for defining a major part of said interior surface, and for imparting to the interior surface a capability to receive and store impingent heat energy from the treatment chamber and to re-radiate stored heat energy back into the treatment chamber, and with each of the elongate assemblies being formed by carrying out the following steps:

i) selecting a castable refractory material that, when cast, will form a rigid elongate cast refractory member that will exhibit good service life when exposed to temperatures in excess of 2,000 degrees Fahrenheit;

ii) casting said selected castable refractory material so as to mold-form said rigid elongate cast refractory member so that is has a generally T-shaped cross-section that is in direct contact with one side of the sheet of steel;

iii) providing reinforcement means that is securely connected to said one side of the sheet of steel and that is configured to extend into and become anchored within the T-shaped cross-section of said rigid elongate cast refractory member;

iv) providing at least one bolt hole that extends through the T-shaped cross-section of said rigid elongate cast refractory member in a direction that substantially parallels a plane within which nearby portions of the sheet of steel extend;

v) positioning at least a short length of angle iron so that one of the two right-angle legs of the angle iron is in contact with said one side of the sheet of steel, and so that the other of the legs is intersected by the axis of the bolt hole;

vi) providing a hole in said other of the legs with said hole being axially aligned with the bolt hole;

vii) installing a bolt in the aligned hole and bolt hole to rigidly connect the angle iron with said rigid elongate cast refractory member; and, viii) welding said one of the legs to said one side of the sheet of steel to securely connect the angle iron with the sheet of steel.

39. The method of claim 37 additionally including the step of installing refractory fiber so that it is interposed between portions of at least one adjacent pair of the side-by-side elongate assemblies.

40. The insulated wall panel of claim 38 wherein the method of its formation additionally includes the step of installing refractory fiber so that it is interposed between portions of at least one adjacent pair of the side-by-side elongate assemblies.

41. The method of claim 37 additionally including the step of installing refractory mortar so that it is interposed between portions of at least one adjacent pair of the side-by-side elongate assemblies.

42. The insulated wall panel of claim 38 wherein the method of its formation additionally includes the step of installing refractory mortar so that it is interposed between portions of at least one adjacent pair of the side-by-side elongate assemblies.

43. A method of forming an insulated wall panel for use in minimizing the loss of heat energy from the treatment chamber of a high temperature furnace extending about selected peripheral portions of the treatment chamber so as to receive and store some impingent heat energy that is received from the treatment chamber, and by reradiating some of the stored heat energy back into the treatment chamber comprising the steps of:

a) providing frame means for defining a rigid support structure that is positionable to extend along selected portions of the periphery of a treatment chamber of a high temperature furnace, with the thus-positioned rigid support structure having inwardly facing portions that face generally toward the treatment chamber in an "inward" direction, and having outwardly facing portions that face generally away from the treatment chamber in an "outward" direction;

b) connecting insulation means to the frame means so that a body of insulation is provided that has an interior surface that overlies and faces inwardly along said selected portions of the periphery of a treatment chamber to diminish loss of heat energy from the treatment chamber; and, c) with the step of connecting the insulation means including the step of connecting a plurality of rigid, elongate assemblies that each include a sheet of steel and an elongate body of cast refractory material of generally T-shaped cross-section, with the elongate assemblies being arranged in spaced, side-by-side relationship for defining a major part of said interior surface, and for imparting to the interior surface a capability to receive and store impingent heat energy from the treatment chamber and to re-radiate stored heat energy back into the treatment chamber, and with each of the elongate assemblies being formed by carrying out the following steps:

i) selecting a castable refractory material that, when cast, will form a rigid elongate cast refractory member that will exhibit good service life when exposed to temperatures in excess of 2,000 degrees Fahrenheit;

ii) casting said selected castable refractory material so as to mold-form said rigid elongate cast refractory member so that is has a generally T-shaped cross-section that is in direct contact with one side of the sheet of steel;

iii) providing reinforcement means that is securely connected to said one side of the sheet of steel and that is configured to extend into and become anchored within the T-shaped cross-section of said rigid elongate cast refractory member;

iv) providing at least one passage that extends through the T-shaped cross-section of said rigid elongate cast refractory member in a direction that substantially parallels a plane within which nearby portions of the sheet of steel extend, with said passage opening through a side surface portion of said rigid elongate cast refractory member;

v) providing rigid structural support means for being rigidly connected both to the sheet of steel and to the T-shaped cross-section of the rigid elongate cast refractory member, including a length of rigid material that defines:

1) a first surface portion that is positioned to extend along and in contact with said one side of the sheet of steel;

2) a second surface portion that is positioned to extend along and in contact with said side surface portion of said rigid elongate cast refractory member; and, 3) a hole formed through said second surface portion and extending in alignment with the passage that is formed through said rigid elongate cast refractory member;

vi) rigidly connecting the length of rigid material to the rigid elongate cast refractory member by installing fastening means to extend through said aligned hole and passage; and, vii) rigidly connecting the length of rigid material to the sheet of steel.

44. An insulated wall panel for use in minimizing the loss of heat energy from the treatment chamber of a high temperature furnace extending about selected peripheral portions of the treatment chamber so as to receive and store some impingent heat energy that is received from the treatment chamber, and by re-radiating some of the stored heat energy back into the treatment chamber, wherein the insulated wall panel is formed in accordance with a method comprising the steps of:

a) providing frame means for defining a rigid support structure that is positionable to extend along selected portions of the periphery of a treatment chamber of a high temperature furnace, with the thus-positioned rigid support structure having inwardly facing portions that face generally toward the treatment chamber in an "inward" direction, and having outwardly facing portions that face generally away from the treatment chamber in an "outward" direction;

b) connecting insulation means to the frame means so that a body of insulation is provided that has an interior surface that overlies and faces inwardly along said selected portions of the periphery of a treatment chamber to diminish loss of heat energy from the treatment chamber; and, c) with the step of connecting the insulation means including the step of connecting a plurality of rigid, elongate assemblies that each include a sheet of steel and an elongate body of cast refractory material of generally T-shaped cross-section, with the elongate assemblies being arranged in spaced, side-by-side relationship for defining a major part of said interior surface, and for imparting to the interior surface a capability to receive and store impingent heat energy from the treatment chamber and to re-radiate stored heat energy back into the treatment chamber, and with each of the elongate assemblies being formed by carrying out the following steps:

i) selecting a castable refractory material that, when cast, will form a rigid elongate cast refractory member that will exhibit good service life when exposed to temperatures in excess of 2,000 degrees Fahrenheit;

ii) casting said selected castable refractory material so as to mold-form said rigid elongate cast refractory member so that it has a generally T-shaped cross-section that is in direct contact with one side of the sheet of steel;

iii) providing reinforcement means that is securely connected to said one side of the sheet of steel and that is configured to extend into and become anchored within the T-shaped cross-section of said rigid elongate cast refractory member;

iv) providing at least one passage that extends through the T-shaped cross-section of said rigid elongate cast refractory member in a direction that substantially parallels a plane within which nearby portions of the sheet of steel extend, with said passage opening through a side surface portion of said rigid elongate cast refractory member;

v) providing rigid structural support means for being rigidly connected both to the sheet of steel and to the T-shaped cross-section of the rigid elongate cast refractory member, including a length of rigid material that defines:

1) a first surface portion that is positioned to extend along and in contact with said one side of the sheet of steel;

2) a second surface portion that is positioned to extend along and in contact with said side surface portion of said rigid elongate cast refractory member; and, 3) a hole formed through said second surface portion and extending in alignment with the passage that is formed through said rigid elongate cast refractory member;

vi) rigidly connecting the length of rigid material to the rigid elongate cast refractory member by installing fastening means to extend through said aligned hole and passage; and, vii) rigidly connecting the length of rigid material to the sheet of steel.

45. The method of claim 43 additionally including the step of installing refractory fiber so that it is interposed between portions of at least one adjacent pair of the side-by-side elongate assemblies.

46. The insulated wall panel frame of claim 44 additionally including the step of installing refractory fiber so that is it interposed between portions of at least one adjacent pair of the side-by-side elongate assemblies.

47. The method of claim 43 additionally including the step of installing refractory mortar so that it is interposed between portions of at least one adjacent pair of the side-by-side elongate assemblies.

48. The insulated wall panel frame of claim 44 additionally including the step of installing refractory mortar so that is it interposed between portions of at least one adjacent pair of the side-by-side elongate assemblies.

* * * * *